US006805088B2

(12) United States Patent
Tachibana et al.

(10) Patent No.: US 6,805,088 B2
(45) Date of Patent: Oct. 19, 2004

(54) AIR INTAKE SYSTEM OF ENGINE

(75) Inventors: Yuki Tachibana, Tokyo (JP); Kensuke Kobayashi, Tokyo (JP); Yuji Chiba, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 70 days.

(21) Appl. No.: 10/212,088

(22) Filed: Aug. 6, 2002

(65) Prior Publication Data

US 2003/0024496 A1 Feb. 6, 2003

(30) Foreign Application Priority Data

Aug. 6, 2001 (JP) ..... 2001-237952
Aug. 6, 2001 (JP) ..... 2001-237969
Aug. 6, 2001 (JP) ..... 2001-237987
Aug. 6, 2001 (JP) ..... 2001-237998

(51) Int. Cl.[7] ..... F02M 35/10

(52) U.S. Cl. ..... 123/184.47; 123/198 E; 123/563; 123/572

(58) Field of Search ..... 123/184.21, 184.42, 123/184.47, 198 E, 563, 572

(56) References Cited

U.S. PATENT DOCUMENTS 4,501,235 A * 2/1985 Muller ..... 123/184.42
6,024,066 A * 2/2000 Nakayama et al. .... 123/184.21
6,067,953 A * 5/2000 Bloomer ..... 123/184.21

FOREIGN PATENT DOCUMENTS

| | | |
|---|---|---|
| EP | 0 786 330 A | 7/1997 |
| EP | 1 005 978 A | 6/2000 |
| JP | 8-334070 | 12/1996 |
| JP | 318056 | 12/1998 |

* cited by examiner

*Primary Examiner*—Noah P. Kamen
(74) *Attorney, Agent, or Firm*—Smith, Gambrell & Russell, LLP

(57) ABSTRACT

In the air intake system of an engine which introduces air passed through a cleaner case having filter element therein into a throttle box through a throttle, and distributes the air from the throttle box to each cylinder of the engine by an intake manifold, the throttle is provided in the throttle box such that a center axis of the throttle is provided substantially horizontally and in a center in the vertical direction between the ends on the upstream side of the intake pipes. The intake pipes are provided on both sides of the throttle box and the throttle is connected to the throttle box such that a center axis of the throttle is arranged substantially horizontal and, simultaneously, an intake route for linking the throttle (including the main port) to the filter element is substantially arranged linearly on the center axis of the throttle. Also, the inside of the cleaner case is in the form of a hollow and is divided by a partition into the air cleaner case and a blowby room. The throttle box and the intake manifold are separately formed in advance and then are monolithically connected to each other.

30 Claims, 22 Drawing Sheets

AIR INTAKE SYSTEM OF ENGINE

BACKGROUND OF THE INVENTION

1. Field of the Invention

The present invention relates to an air intake system of an engine, especially to a unitization of the air intake system mounted on a vehicle.

2. Description of the Related Art Including Information Disclosed under 37 CFR 1.97 and 1.98

In a conventional air intake system, a throttle and an air flowmeter or an air cleaner case are connected to each other by a duct in an engine room (compartment) and the air cleaner case is connected to a vehicle body. The air intake system requires a large space for arranging the air intake system between the air cleaner case and the engine, and a long connection line by the duct because the air cleaner case is mounted on the body. Therefore a large amount of man-hours is needed for designing an arrangement of members in an engine room. It is necessary to design the members so as to effectively fit to space and form of the engine room for every different kind of the vehicles, and therefore standardization or modularization of each of the members is difficult.

In order to solve the above problem, JP-A8-334070 discloses an air intake system shown in FIG. 21. The air intake system is composed of an air cleaner case 110 comprising an air cleaner cap 112 and a dusty side case 11 provided in a vicinity of a cylinder head of an engine 100, a surge tank 130 comprising a surge tank cap 132 and a lower case 131 provided on opposite side to the air cleaner case 110 at a different side of the engine, a throttle 140 connecting to the air cleaner case 110, and an intake manifold 120 molded in a form of a tube by an upper wall side 121 and a lower wall side 122 extending from the surge tank 130 to an intake port of the engine 100 through an under side of the air cleaner case 110. As shown in FIG. 22, the dusty side case 111 of the air cleaner case 110, the upper wall side 121 of the intake manifold 120, and the surge tank 130 of the lower case 131 are monolithically molded by using a plastic resin to form a housing. The upper wall side 121 is used in combination with a bottom side of the dusty side case 111 and a bottom side of the lower case 131.

Then, the air cleaner case 110, the throttle 140, the surge tank 130 and the intake manifold 120 are assembled to be united whereby the intake system is prepared, respectively. The publication has suggested attaching the intake system to the engine 100 as a unit.

JP-A10-318056 discloses an intake system shown in FIG. 23. The intake system is provided with an air cleaner case 153 having an element 152 therein, a throttle 154 into which air passed through the air cleaner case 153 is introduced, and the intake manifold 155 for introducing the air passed through the throttle 134 to the side of the engine 100, and further provided with a bottom case 162 molded monolithically including the air cleaner case 153 and a part 156 of the intake manifold 155, an intermediate case 163 which is removable from the case bottom 162 and inside which the element 152 is stalled, and a case cover 161 which is removable from the intermediate case 163 and which covers the air cleaner case 153.

SUMMARY OF THE INVENTION

According to the disclosures of JP-A8-334070 and JP-A10-318056, the intake system including the air cleaner case to the intake manifold is integrated as a unit, and it is mounted onto the engine as the unit. Therefore, the intake system is totally provided in the vicinity of the engine whereby the space within the engine room can be reduced and design of the arrangement of the members within the engine room can be easily carried out.

However, since the air cleaner case and the throttle are arranged over the intake manifold connected to the engine, the height of the intake system is increased to reduce clearance between the intake system and a hood covering the engine room. As a result, in case a pedestrian is contacted with a hood to apply impact load onto the hood, deformation of the hood is disturbed by the intake system. Therefore a disturbance affects adversely an absorption or decrease of the impact energy by the deformation of the hood. In contrast, in case the hood is raised for ensuring sufficient crush stroke, visible range of a driver or running resistance is affected badly and freedom of a body design is restricted.

In view of the above-mentioned problems, an object of the invention is to provide the air intake system which is mounted over the engine such as a horizontally opposed engine or V-type engine and which can be compactly prepared and easily modularized.

A first invention to attain the above object is provided by an air intake system of an engine which introduces air passed through a cleaner case having a filter element therein into a manifold through a throttle, and distributes the air from the manifold to each of cylinders of the engine by an intake element. The manifold is mounted on the upper side of the engine through the intake element connected to both sides of the manifold opposite to each other, and the cleaner case is connected to the manifold. The intake element also has plural intake pipes which are provided side by side and vertically to both of the sides of the manifold opposite to each other and of which each end on an upstream side of the intake pipes is opened and each end on a downstream side of the intake pipes connects to each of intake ports of the engine. In addition, the throttle is provided in the manifold such that a center axis of the throttle is substantially horizontal and centered in the vertical direction between the ends on the upstream side of the intake pipes provided vertically and extends to a center between the ends on the upstream side opposite to each other provided on both sides of the manifold.

According to the above invention, the throttle is provided such that a center axis of the throttle is provided substantially horizontal and in a center in a vertical direction between the ends on the upstream side of the intake pipes vertically provided and extended to a center between the ends on the upstream side opposite to each other provided on both sides of the manifold. Therefore, an occurrence of turbulent flow of air in the manifold is depressed, and the air is fed evenly to each of the intake pipes, and further the air is introduced horizontally into the manifold, whereby the height of the manifold can be reduced, and simultaneously the height of the cleaner case can be effectively reduced. Moreover, the connection of the manifold to the cleaner case requires no duct to become compact of an intake system.

Hence, in case the intake system of the present invention is mounted in the engine room, clearance between the hood and the intake system can be easily ensured. Therefore, even if the pedestrian applies impact load onto the hood from the upper side, sufficient crush stroke can be ensured and the impact energy can be sufficiently absorbed or reduced by the deformation of the hood with safety to pedestrian being improved. On the other hand, the hood can be lowered without affecting the intake system, i.e., slant nose can be adopt, whereby the visibility of the driver and the reduction of the running resistance can be expected and freedom of the design of the body is extended.

The manifold and the cleaner case can be mounted on the engine through the intake element as a sub-assembly unit. Therefore the production can be efficiently conducted, and the intake system is formed compactly, whereby it is easily mounted on other kinds of vehicles having the restricted form or effectively-spaced engine and the modularity is easily carried out.

A second invention to attain the above object is provided by an intake system of an engine which introduces air passed through a cleaner case having a filter element therein into a manifold through a main port and a throttle, and distributes the air from the manifold to each of cylinders of the engine by an intake element. The manifold is mounted on the upper side of the engine through the intake element connected to the manifold, and the cleaner case is connected to the manifold. The throttle is also connected to the manifold such that the center axis of the throttle is provided substantially horizontal and simultaneously an intake route of linking the throttle including the main port to the filter element is substantially linearly provided on the center axis of the throttle.

According to the above invention, the air is introduced horizontally into the manifold whereby the height of the manifold can be reduced, and further since the main port and the filter element are substantially arranged linearly on the extension of the center axis of the throttle extended substantially horizontally, resistance to intake in a route from the air cleaner to the throttle through the main port can be reduced and simultaneously the height of the cleaner case can be effectively reduced. Moreover, the connection of the manifold to the cleaner case requires no duct to make a compact intake system.

Hence, in case the intake system of the present invention is installed in the engine room, the clearance between the hood and the intake system can be sufficiently ensured. Therefore, even if the pedestrian applies impact load onto the hood from the upper side, the sufficient crush stroke can be ensured whereby the impact energy can be sufficiently absorbed or reduced by the deformation of the hood with safety to pedestrian being improved. On the other hand, the hood can be lowered, in this case the so-called slant nose can be adopt, whereby visibility of the driver and reduction of running resistance can be expected and the freedom of the body design is extended.

The manifold and the cleaner case can be mounted on the engine through the intake element as the sub-assembly unit. Therefore the production or the installation can be efficiently conducted, and the intake system is formed compactly, whereby it is easily mounted on other kinds of the vehicles provided with the engine room having the restricted form or the effective-space and the modularity is easily carried out.

A third invention to attain the above object is provided by an air intake system of an engine which introduces air passed through a cleaner case having a filter element therein into a manifold through a throttle, and distributes the air from the manifold to each of cylinders of the engine by an intake element, wherein the manifold is mounted on the upper side of the engine through the intake element connected to the manifold, the cleaner case, which in the form of a hollow, is connected to the manifold, and obtained by monolithically forming both of the filter cleaner case having the filter element divided by a partition therein and a blowby room constituting a blowby gas reflux system.

According to the above invention, the inside of the cleaner case in the form of the hollow is divided by the partition into the air cleaner case and a blowby room, and therefore both of the air cleaner case and the blowby room can be monolithically formed and compactified. Further the connection of the manifold to the cleaner case also requires no duct to make the intake system compact.

Hence, in case the intake system of the invention is installed in the engine room, the clearance between the hood and the intake system can be sufficiently ensured. Therefore, even if the pedestrian applies impact load onto the hood from the upper side, the sufficient crush stroke can be ensured and the impact energy can be sufficiently-absorbed or reduced by the deformation of the hood with safety to pedestrian being improved. On the other hand, the hood can be lowered, in this case the so-called slant nose can be adopt, whereby visibility of the driver and reduction of running resistance can be expected and the freedom of the body design is extended.

Further, the manifold and the cleaner case can be mounted on the engine as the sub-assembly unit. Therefore the production can be efficiently conducted, and the intake system is formed compactly, whereby it is easily mounted on other kinds of vehicles provided with the engine room having the restricted form or effectively-spaced vehicle and the modularity is easily carried out.

The embodiments of the first, second and third inventions are as follows:

In the first invention, it is preferred that the cleaner case has the filter cleaner case having the filter element therein and the main port leading the air from the air cleaner case to the throttle, and the intake air route of linking the throttle including the main port to the filter element is substantially arranged linearly on an extension of the center axis of the throttle.

According to the above embodiment, the intake route of linking the throttle to the filter element is substantially arranged linearly on the extension of the center axis of the throttle, whereby resistance to intake of the route from the air cleaner to the throttle through the main port can be reduced and the height of the air cleaner case can be effectively lowered.

In the third invention, it is preferred that the cleaner case is connected to the manifold at substantially the same height as each other.

According to the above embodiment, the clearance between the hood and the intake system is more easily ensured by connecting the cleaner case and the manifold at substantially the same height.

In the first, second and third inventions, preferred is the following embodiment: the cleaner case has;

the cleaner case body molded monolithically from a resin, which has the lower portion of air cleaner case opening the upper side and having the filter element therein and the lower portion of the blowby room opening its upper side which are divided into by a partition, the case cover molded monolithically from a resin, which has the upper portions of the air cleaner case and the blowby room which cover the upside of the lower portions of the air cleaner case and the blowby room, the cleaner case is a hollow cleaner case and includes the lower and upper portions of the air cleaner case into which the filter element is installed and which is formed by combining the cleaner case body to the case cover, and the blowby room is formed from the lower and upper portions of the blowby room, which constitute a blowby gas reflux system.

According to the above embodiment, the air cleaner case into which the filter element is incorporated and the compacted cleaner case in the vicinity of the blowby case are easily produced by the cleaner case body and the case cover which are formed from the resin having excellent molding properties and capable of providing a light molded product. Therefore the cost for the production can be reduced. Moreover, the cleaner case, which may contact the hood by the deformation when the pedestrian contacts the hood to apply impact load onto the hood, is formed from a relatively flexible resin, whereby safety to pedestrian is improved.

In the first, second and third inventions, preferred is the following embodiment: the cleaner case body is molded monolithically such that the main port, which leads the air from the inside of the air cleaner case to the throttle through the lower portions of the air cleaner and the blowby room, is further incorporated into the cleaner case body.

According to the above embodiment, the blowby room is formed between the air cleaner case and the manifold by the provision of the main port of passing through the air cleaner to protrude from the air cleaner case, whereby a compact cleaner case having collectively three functions of the air cleaner case, the manifold and the main port can be formed.

In the third invention, it is preferred that the blowby room comprises a first blowby room separating foreign matters from a fresh air fed from the air cleaner to a crank case of the engine and a second blowby room separating the foreign matters from the blowby gas recycling between the crank case of the engine and the manifold, the first and second blowby rooms being divided by a partition wall.

According to the above embodiment, the blowby room is divided by a partition wall whereby the first and second blowby rooms can be formed, a first blowby room separating the foreign matters in the fresh air to be fed from the air cleaner to the crank case of engine and the second blowby room separating the foreign matters of the blowby gas recycling between the crank case of engine and the manifold.

In the first, second and third inventions, preferred is the following embodiment: a fixing member for supporting an air flowmeter is provided on the cleaner case body or the case cover.

According to the above embodiment, the air flowmeter can be easily mounted on the cleaner case by providing a fixing member for supporting the air flowmeter on the cleaner case body or the case cover.

In the first invention, it is preferred that the intake element is divided into a pair of intake elements each of which is connected to each of the sides of the manifold.

According to the above embodiment, since the intake element is connected to each of the sides of the manifold, it is possible to connect another different intake element to the manifold depending upon a different specification including engine performance. In other words, the manifold can be used in common in various engines. Further, the intake element is dividedly structured to enable the intake element to compact, whereby a mold for molding the intake element can be compacted with reduction of the production cost. Furthermore each of the intake elements is prepared in the same structure and therefore the kinds of constituent members can be reduced with enhancement of the productivity.

In the first invention, it is preferred that an inter cooler is connected to the manifold at substantially the same height as the manifold instead of the cleaner case.

According to the above embodiment, the inter cooler is connected to the manifold instead of the cleaner case and therefore the manifold and the intake element can be also used in a turbo engine.

A fourth invention to attain the above object is further provided by an intake system of an engine which introduces air passed through a cleaner case having a filter element therein into a manifold through a throttle, and distributes the air from the manifold to each of cylinders of the engine by an intake element, wherein the manifold and the intake element, which are separately formed in advance, are bonded to each other by monolithically connecting an installation opening which opens at the manifold to an end on an upstream side of the manifold, and an end on a downstream side of the intake element is mounted on an upper side of the engine.

According to the above invention, the manifold and the intake element are separately formed in advance, and then are monolithically connected to each other. Therefore, the manifold and the intake element can be designed without considering influence therebetween, that is, the freedom of the design of the manifold and the intake element is ensured to permit compactification of the manifold and further compactification of the intake system.

Consequently, in case the intake system of the present invention is installed in the engine room, the clearance between the hood and the intake system can be easily ensured. Even if a pedestrian applies impact load onto the hood from the upper side, the sufficient crush stroke can be ensured whereby the impact energy can be sufficiently absorbed or reduced by the deformation of the hood with safety to pedestrian being improved.

Further, with compared to the monolithic molding of the manifold and the intake element, the intake system of the invention permits simplification and compactification of the shape to facilitate the molding, and simultaneously to bring about miniaturization of the mold thereof and reduction of the production cost.

Furthermore, by substituting the intake element by another one depending upon variation of the engine specification, the intake system of the invention can be used in various engines, and therefore the manifold can be used in common, i.e., can be modularized.

In the fourth invention, it is preferred that the cleaner case is molded monolithically from the resin such that it is connected to the manifold at substantially the same height as each other.

According to the above embodiment, the cleaner case is arranged at substantially the same height as the manifold, and these are connected to each other, whereby no duct is needed and the intake system can be rendered compact. The cleaner case is monolithically molded from the resin having excellent molding properties and capable of providing a light molded product, whereby the cost of the production can be reduced. Moreover, the cleaner case, which may be brought in contact with the hood by the deformation when the pedestrian contacts the hood to apply impact load onto the hood, is formed from a relatively flexible resin, to improve safety to pedestrian.

Since the intake system further has a feature that it can be prepared in the compact form, it can be easily provided in other kinds of vehicle restricted in shape or effective space, and therefore the modularity is facilitated.

In the fourth invention, it is preferred that the manifold has a installation opening which opens at a side of the manifold, ends on the upstream side of the intake element are monolithically connected to the has an installation opening, and the intake element extends in a curve (in the form of bay) downward from said connected point, and the end on the downstream side of the intake element is mounted on the engine.

According to the above embodiment, the ends on the upstream side of the intake element are connected to the has a installation opening of the manifold and curvedly formed downwardly from said connected point, and the ends on the downstream side of the intake element are mounted on the engine. Hence, the space between the manifold and the engine can be reduced and an effective length of the intake element can be ensured.

In the fourth invention, it is preferred that the manifold has installation openings which open at each of both sides of the manifold opposite to each other, the ends on the upstream side of each of the intake elements are monolithically connected to each of the installation openings, and each of the intake elements extends in a curve in the form of bay downward from each of said connected points and a pair of ends on the downstream side of the intake element are mounted on the engine.

According to the above embodiment, in addition to the previous embodiment, each of the intake elements is connected to both sides of the manifold opposite to each other, whereby the manifold can be more stably supported on the engine with the intake being evenly distributing into each of the cylinders.

In the fourth invention, it is preferred that the installation openings which open at both sides of the manifold have the same form as each other, and the openings of a pair of intake elements have the same form as each other.

According to the above embodiment, the installation openings of the intake elements which open at both sides of the manifold have the same form as each other, which results in reduction of the constituent members, whereby the productivity is enhanced and the production cost is expected to decrease.

In the fourth invention, it is preferred that the intake element is provided with intake pipes and installation flanges on the upstream side and the downstream side for connecting ends on the upstream and downstream sides of the intake tube to each of the installation openings of the manifold and an intake port of the engine, the installation flange on the upstream side has a installation flange body in contact with the side surface of the manifold along a periphery of the installation opening and a inserting part, which is protruded on the installation flange, for inserting in the installation opening, and the periphery of the installation opening and the installation flange body are bonded to each other by ultra sonic welding.

According to the above embodiment, the relative positioning of the manifold and the intake element are easily determined by inserting the inserting part on the installation flange at the upstream into the installation opening to bring the installation flange body in contact with the manifold, and the periphery of installation opening and the installation flange body are bonded to each other by ultra sonic welding. Hence, even if the manifold and the intake element are made up of different materials from each other, they can be easily and firmly bonded to each other and the side of the manifold is reinforced, whereby rigidity required in the manifold can be reduced to bring about extend of the design freedom.

In the fourth invention, it is preferred that the manifold is monolithically molded from the resin, and the intake element is monolithically cast (founded) from a metal or the resin, or monolithically molded from the resin.

According to the above embodiment, the manifold not requiring high heat resistance can be monolithically molded from the resin having excellent molding properties, and the miniaturization of the intake element brings about that of production mold whereby the reduction of the production cost and weight can be obtained. Further, the manifold is easily deformed by application of impact load. Therefore, even if a pedestrian applies impact load onto the hood from the upper side, the impact energy is absorbed or reduced by deformation of the hood with safety to pedestrian being improved.

In the fourth invention, it is preferred that wherein the throttle is provided in the manifold such that the center axis of the throttle is substantially horizontal, and the cleaner case has the air cleaner case having the filter element therein and a main port leading the fresh air from the air cleaner case to the throttle, and an intake route linking the throttle, including the main port, to the filter element is arranged linearly on an extension line of the center axis of the throttle.

According to the above embodiment, the intake route of linking the throttle to the filter element is substantially arranged linearly on an extension of the center axis of the throttle, whereby resistance to intake of the route from the air cleaner to the throttle through the main port can be reduced with a height of the air cleaner case being effectively lowered.

In the fourth invention, it is preferred that an inter cooler is connected to the manifold at substantially the same height as the manifold, instead of the cleaner case.

According to the above embodiment, by connecting the inter cooler instead of the cleaner case to the manifold, the manifold and the intake element can be also used in a turbo engine.

DETAILED DESCRIPTION OF THE INVENTION

Embodiments of an air intake system of an engine according to the invention are explained by showing an instance of a horizontally opposed four-cylinder engine with reference to Figures.

First Embodiment

Figure 1:
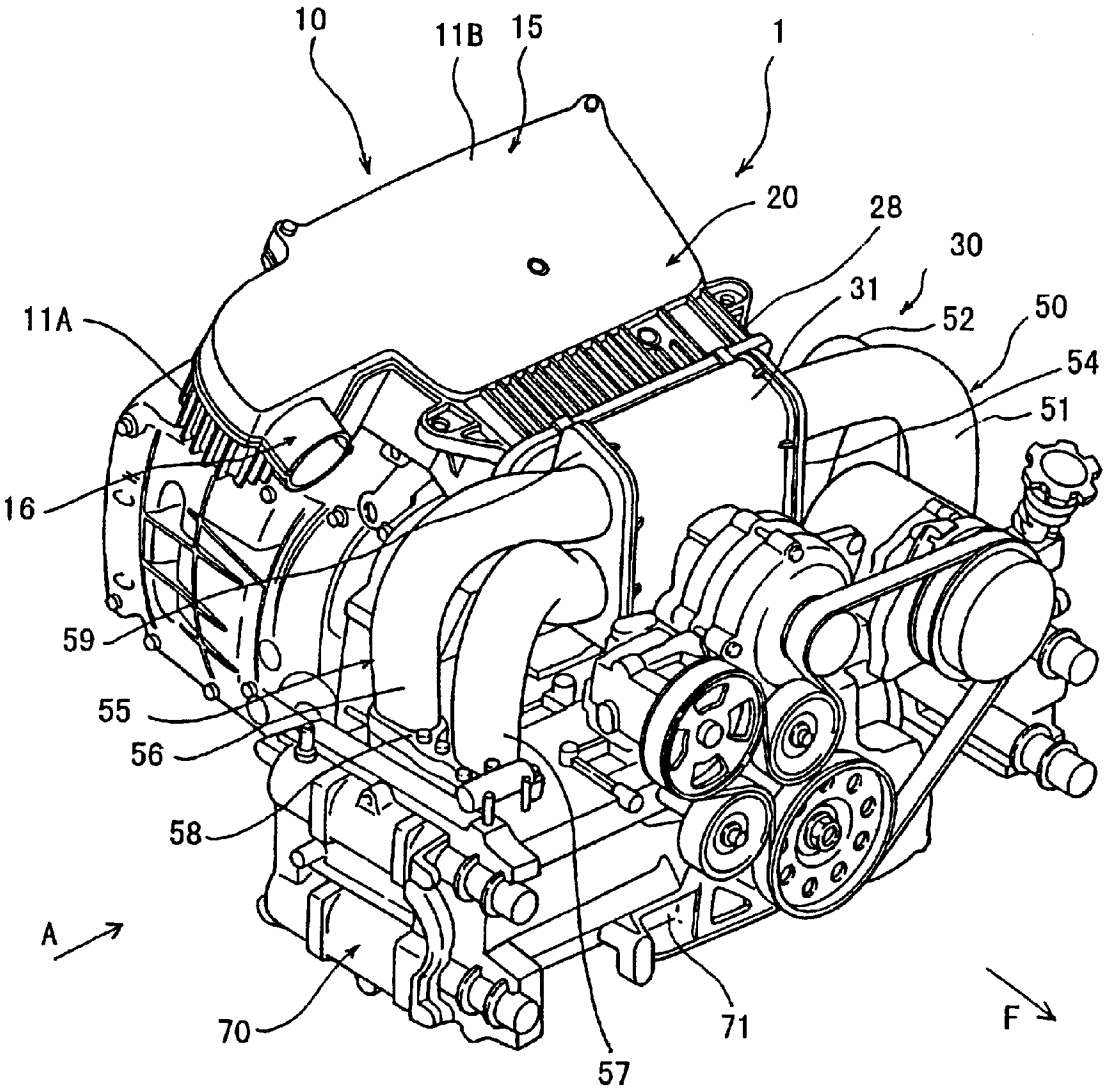
FIG. 1 is a whole oblique view of an engine provided with an air intake system which shows an outline of a first embodiment of the air intake system according to the present invention.
Figure 2:
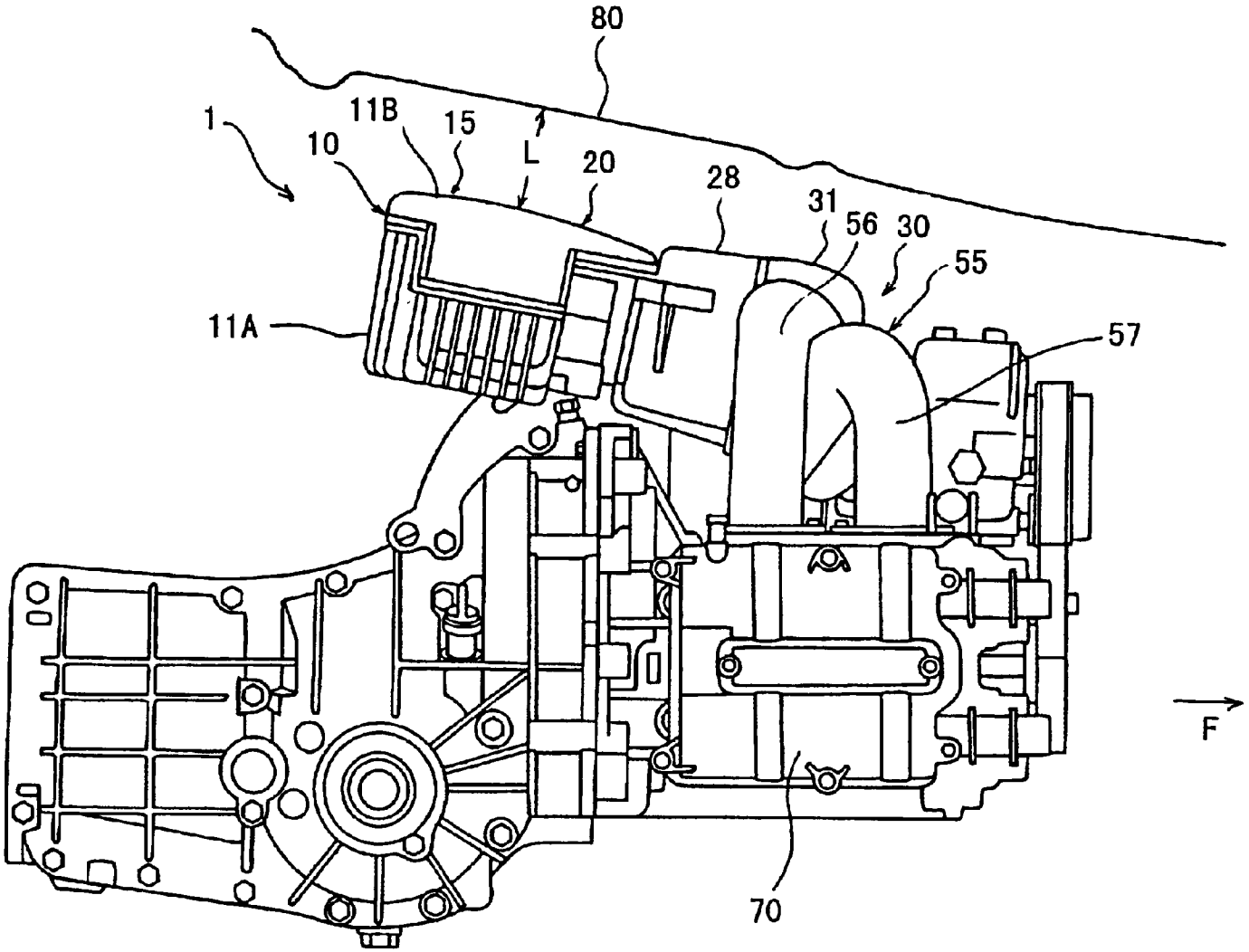
FIG. 2 is a side view of FIG. 1 seen from a direction of an arrow A.
Figure 3:
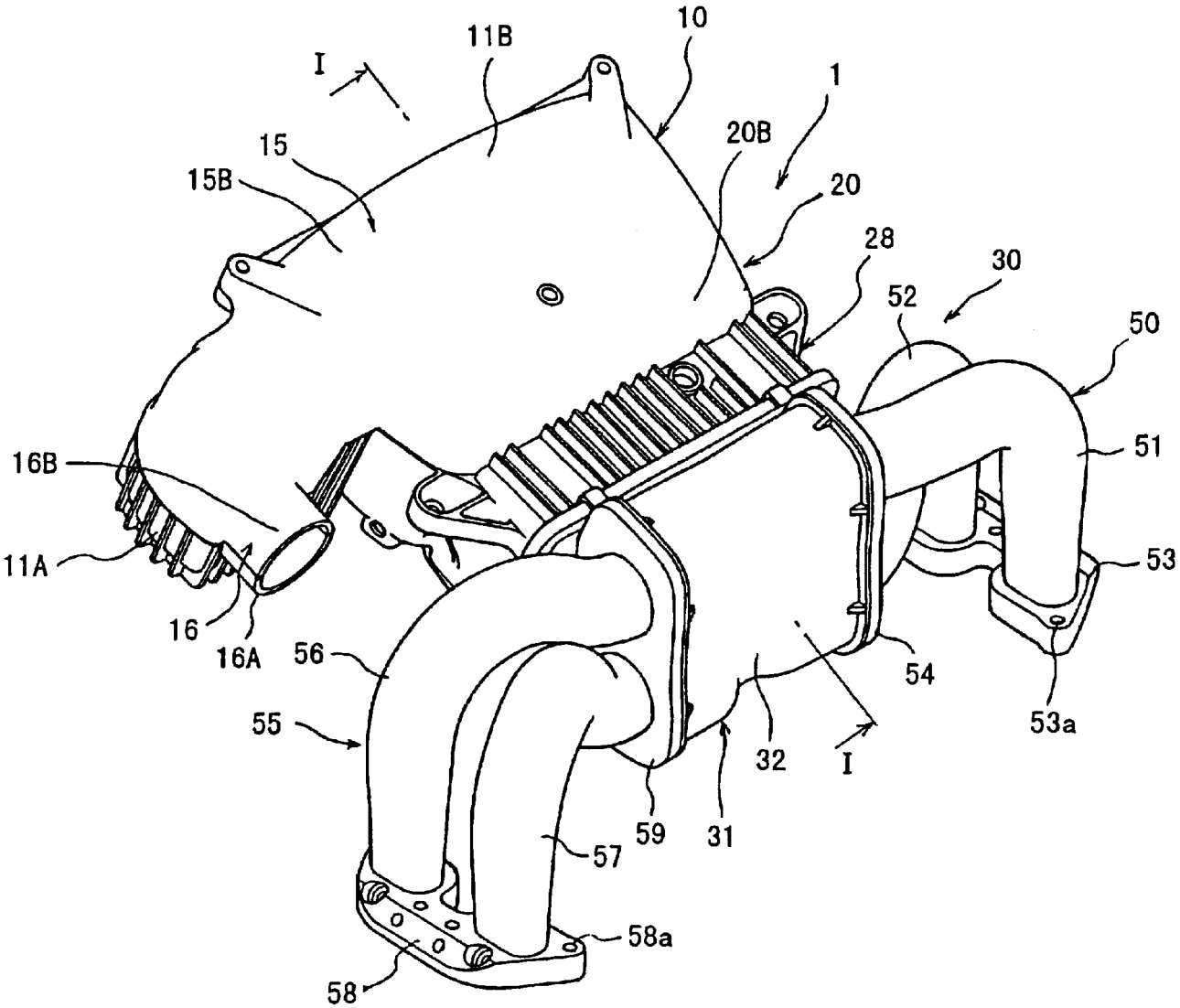
FIG. 3 is a whole oblique view of the intake system of FIG. 1.
Figure 4:
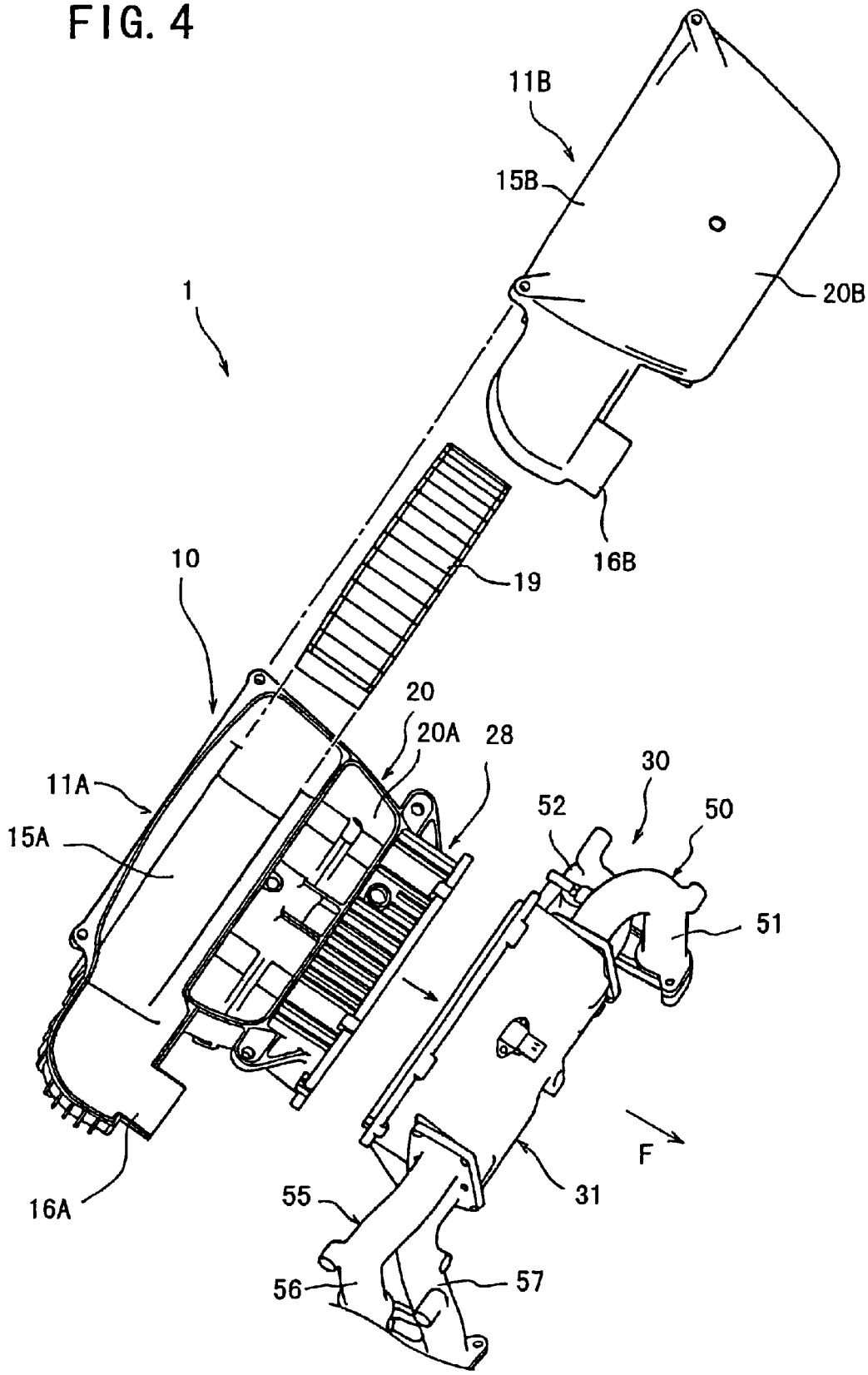
FIG. 4 is an oblique view of the intake system of FIG. 3.
Figure 5:
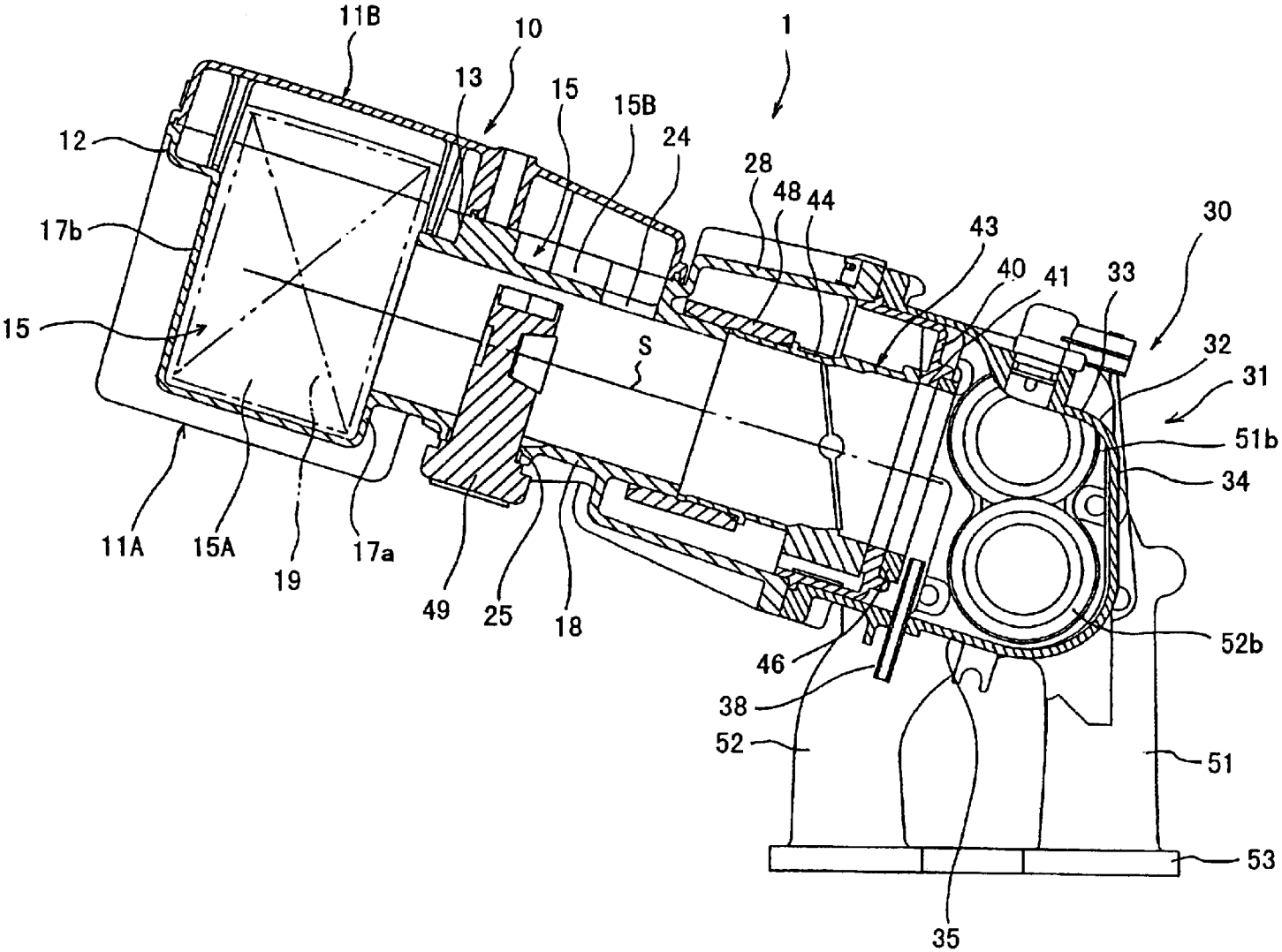
FIG. 5 is a section view of the intake system of FIG. 3 by a line I—I.

A first embodiment is explained based on FIGS. 1 to 18. FIG. 1 shows a whole oblique view of an engine provided with the intake system, FIG. 2 is a side view of FIG. 1 seen from a direction of an arrow A, FIG. 3 is a whole oblique view of the intake system of FIG. 1, FIG. 4 is an oblique deal view of the intake system, and FIG. 5 is a section view of the intake system of FIG. 3 by a line I—I. An arrow F indicates a forward direction of a vehicle body.

As shown in FIGS. 1 to 5, an intake system 1 has a cleaner case 10 monolithically formed from a cleaner case body 11A and a case cover 11B, a throttle box assembly 30 obtained by bonding a pair of intake elements 50, 55 to a manifold 31, and a throttle 43.

Figure 6:
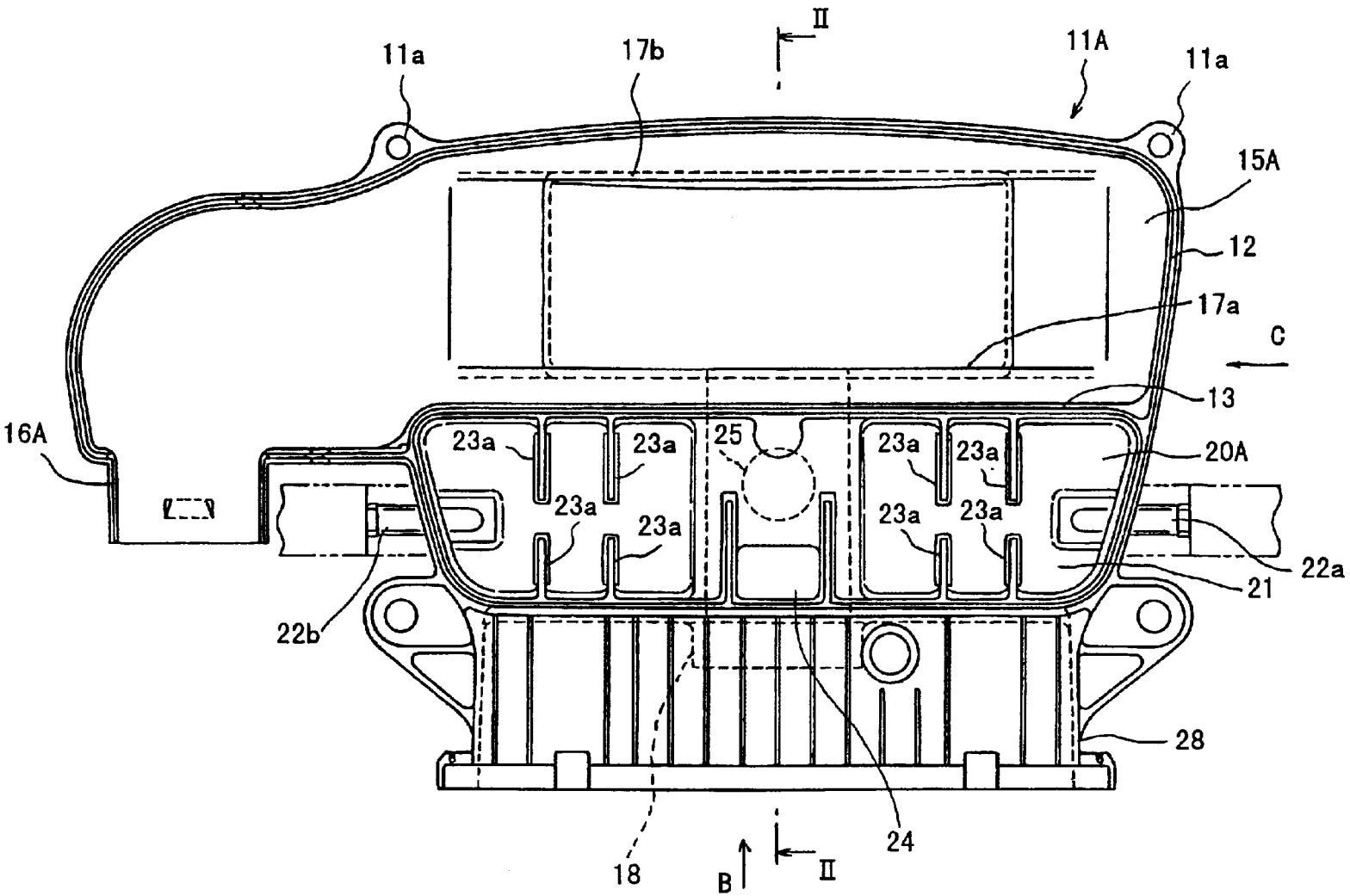
FIG. 6 is a plain view of the cleaner.
Figure 7:
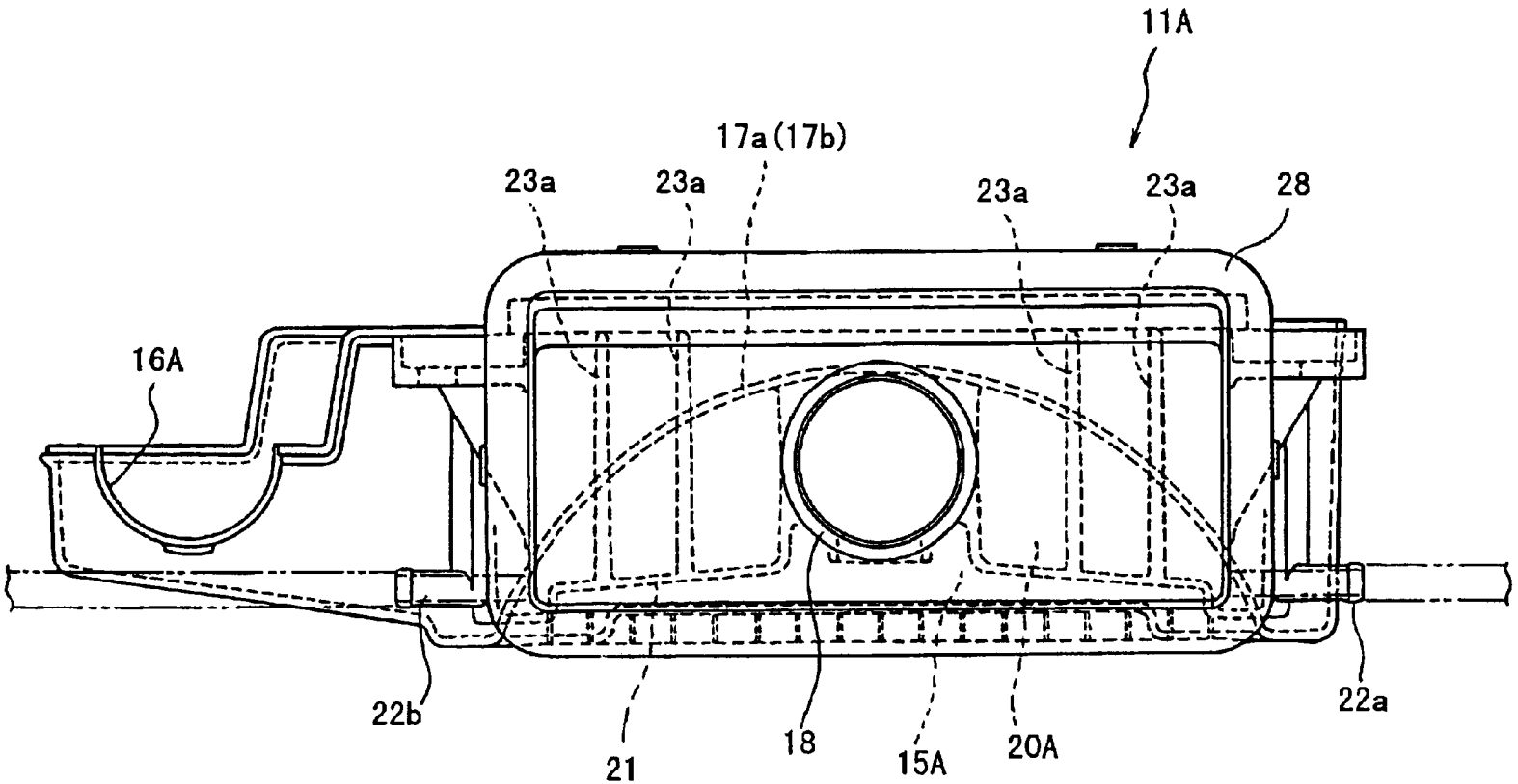
FIG. 7 is the side view of FIG. 6 seen from a direction of an arrow B.
Figure 8:
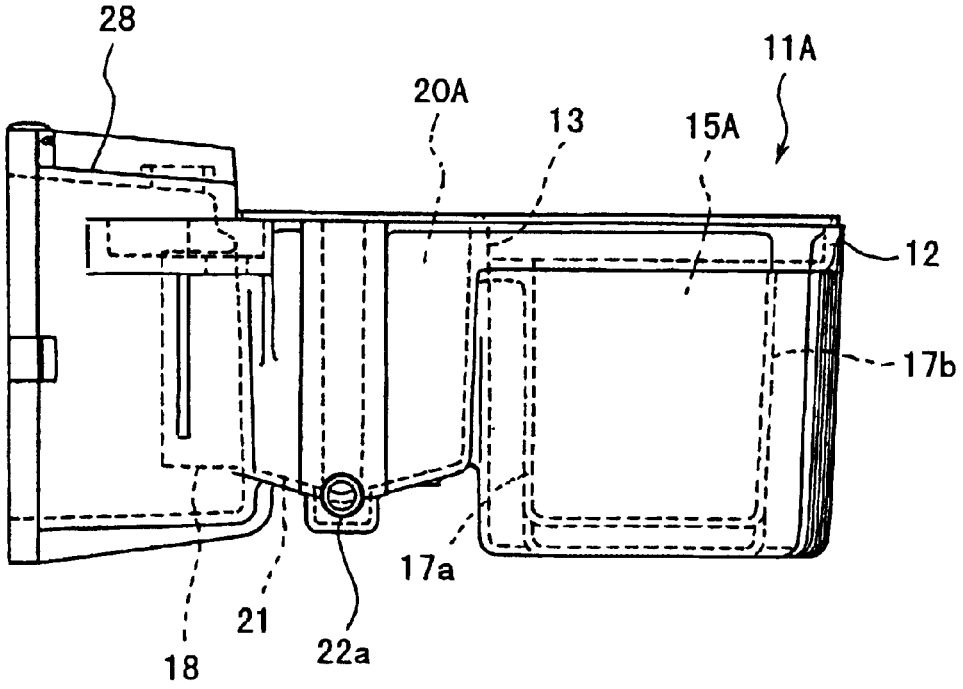
FIG. 8 is the side view of FIG. 6 seen from a direction of an arrow C.
Figure 9:
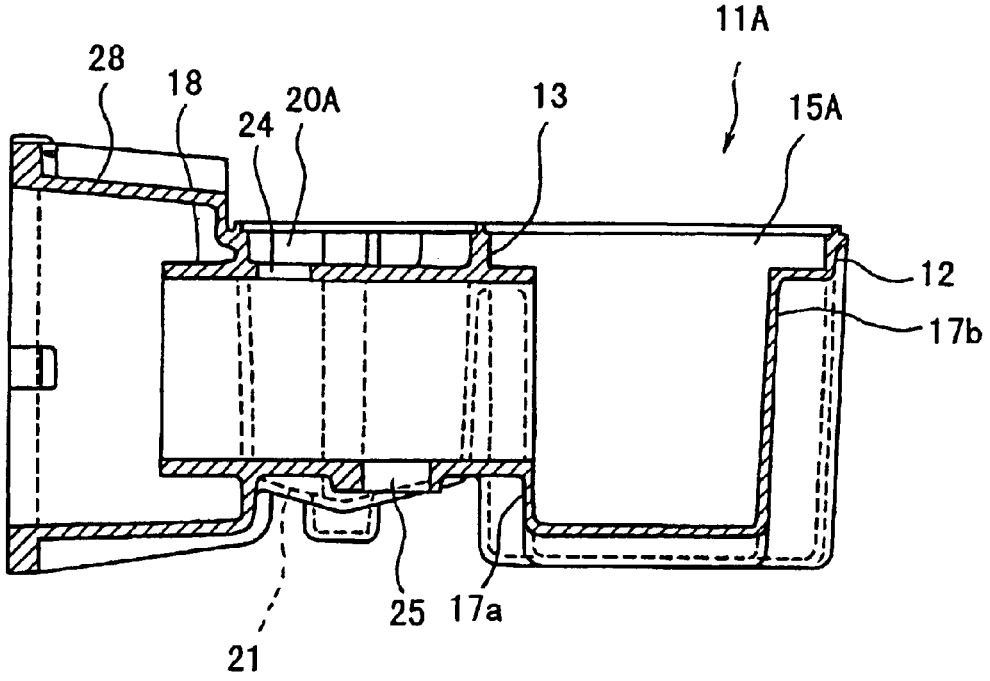
FIG. 9 is a section view of FIG. 6 by a line I–II.

Subsequently a structure of each of the above members is explained in details. In the cleaner case body 11A, which is made up of a resin, a lower portion 15A of an air cleaner case and a lower portion 20A of a blowby room which open the upper sides are formed adjacently each other by dividing longitudinally the inside of a peripheral wall 12 by a partition 13, and a connecting part 28 in the form of approximately rectangle section is extendedly provided in front of the lower portion 20A of blowby room through the peripheral wall 12, as shown in FIG. 6 of a plain view of the cleaner case, FIG. 7 of a side view of FIG. 6 seen from a direction of an arrow B, FIG. 8 of a side view of FIG. 6 seen from the direction of an arrow C and FIG. 9 of a section view of FIG. 6 by a line II—II.

A lower portion 16A of an air inlet in the form of a bubble is extendedly provided on an end of the lower portion 15A of an air cleaner case, and a filter element supporting parts 17*a*, 17*b* having an upper side in the form of circular arc and extending in a vehicle widthwise direction are expanded and formed opposite to each other from the partition 13 and the peripheral wall 12 in the lower portion 15A of air cleaner case. A main port 18 in the form of a cylinder, of which rear end is opened at the lower portion 15A of air cleaner case and passed through the lower portion 20A of a blowby room 20, is protruded and provided in a central area of the partition 13.

A bottom portion 21 of the lower portion 20A of the blowby room descends in the forward and backward directions from a center of longitudinal direction, and as a result, the bottom portion 21 inclines to form a shape of mountain-like section, and connecting holes 22*a*, 22*b* are extruded in the form of a tube from ends of both sides of the bottom portion 21 and are opened. Further plural separators 23*a* are provided on a bottom portion 21 and the partition 13 or the periphery 12 to span between the separators 23*a*. A fresh air introducing hole 24 which is linked with both the lower portion 15A of the air cleaner case and the lower portion 20A of the blowby room is opened on the main port 18.

Figure 10:
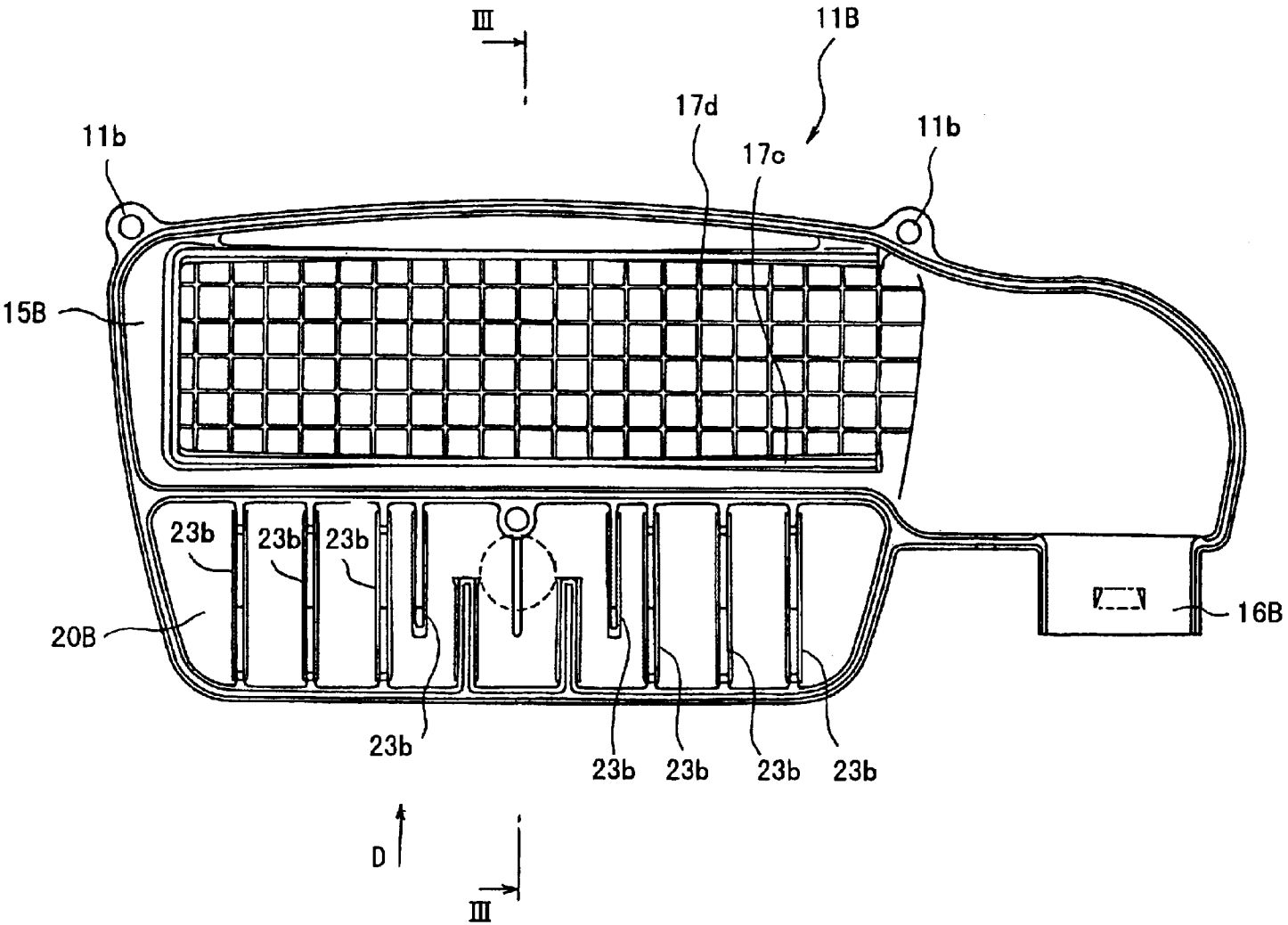
FIG. 10 is a lower side view of the case cover.
Figure 11:
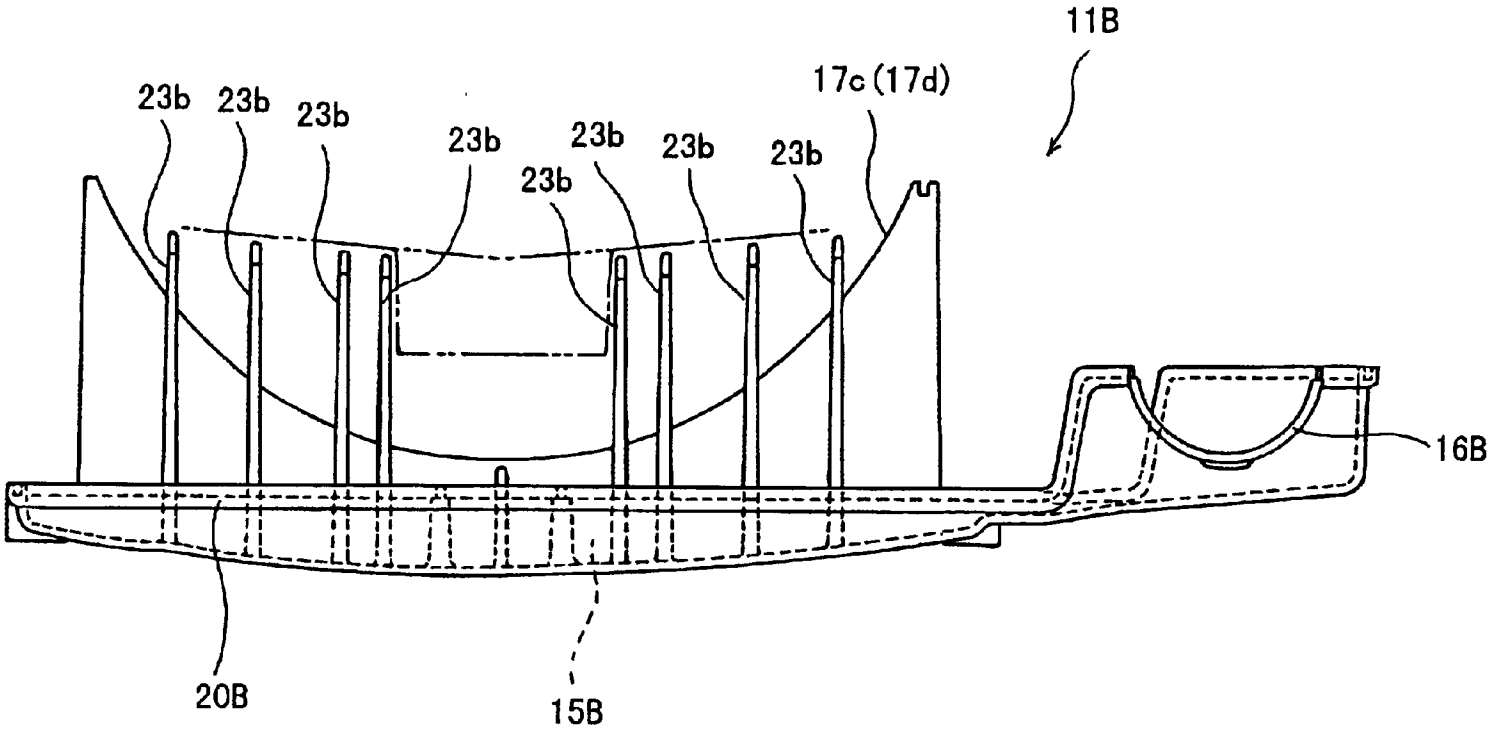
FIG. 11 is the side view of FIG. 10 seen from a direction of an arrow D.
Figure 12:
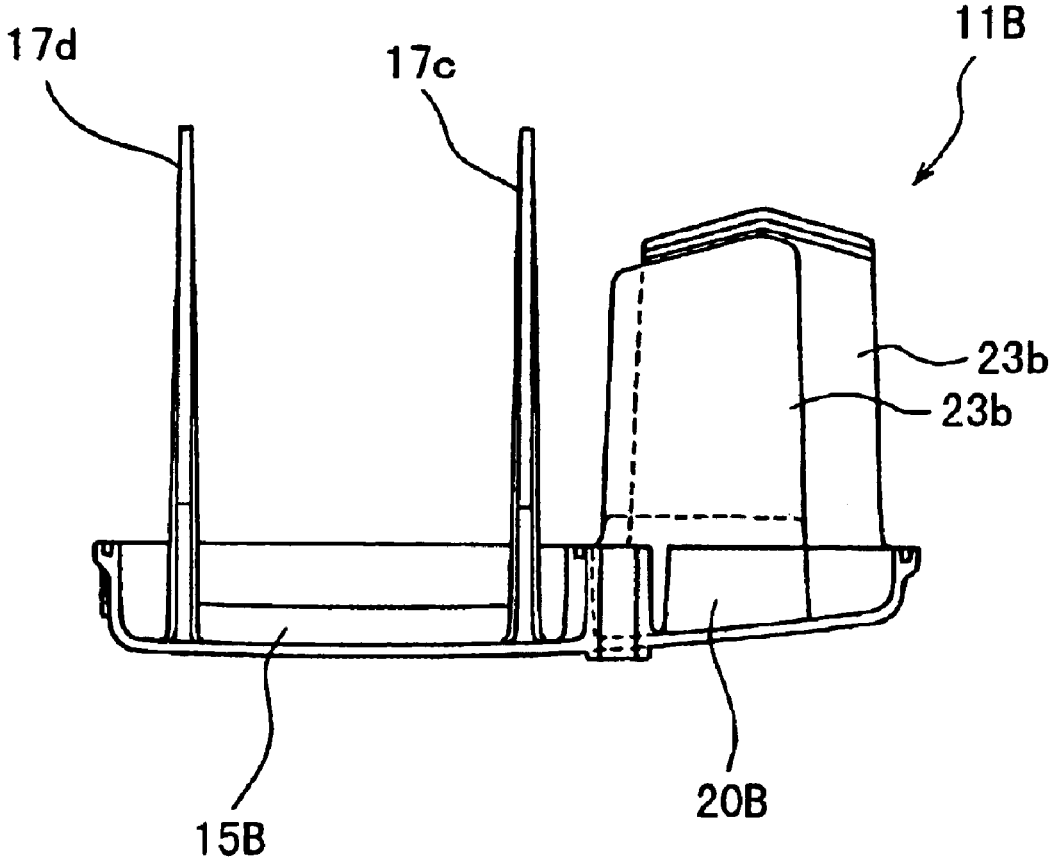
FIG. 12 is the section view of FIG. 10 by a line III—III.

On the other hand, the upper portion 15B of the air cleaner case, the upper portion 20B of blowby room and the upper portion 16B of the air inlet are monolithically formed so as to have such a shape as the case cover 11B, which is made up of the resin, covers the lower portion 15A of the air cleaner case, the lower portion 20A of the blowby room and the lower portion 16A of the air inlet in the cleaner case body 11A and simultaneously the periphery is in close contact with the peripheral wall 12 of the cleaner case body 11A and an end of the upper side of the upper portion 16B of the air inlet, as shown in FIG. 10 of a lower side view of the case cover, FIG. 11 of a side view of FIG. 10 seen from a direction of an arrow D and FIG. 12 of a section view of FIG. 10 by a line III—III. The upper portion 15B of the air cleaner case, the upper portion 20B of the blowby room and the upper portion 16B correspond to the lower portion 15A of air cleaner case, the lower portion 20A of the blowby room and the lower portion 16A of air inlet, respectively.

The upper portion 15B of the air cleaner case is opposed to the lower portion 15A of the air cleaner case, and further supporting parts 17*c*, 17*d* of the filter element of which each has an end in the form of circle arc are extruded in the upper portion 15B corresponding to supporting parts 17*a*, 17*b* of the filter element formed on the lower portion 15A of the air cleaner case.

The upper portion 20B of the blowby room is opposed to the lower portion 20A of the blowby room and further plural separators 23*b* capable of inserting between the separators 23*a* formed on the lower portion 20A of the blowby room are extruded on the upper portion 20B of the blowby room.

The cleaner case body 11A formed as above and the case cover 11B are opposed to each other to be bonded at their junction parts 11*a*, 11*b* with bolts and at the lower portion 16A of the air inlet and the upper portion 16B of the air inlet with clips, whereby the cleaner case 10 in the form of a hollow is formed. In the cleaner case 10, the hollow air cleaner case 15 is formed from the lower portion 15A and the upper portion 15B of the air cleaner case, and the air inlet in the form of a tube 16, which is passed through the air cleaner case 15, is formed from the lower portion 16A and the upper portion 16B of the air inlet. Further, the filter element 19 is supported at a predetermined position by supporting parts 17*a*, 17*b* of the filter element extruded on the cleaner case body 11A and by maintaining parts 17*c*, 17*d* of the filter element extruded on the cleaner case body 1A. The blowby room 20 is formed such that the inside formed from the lower portion 20A and the upper portion 20B of the blowby room is made to labyrinthine shape by the separators 23*a*, 23*b* dividing the inside, and the connecting holes 22*a*, 22*b* are opened on both the sides, and further the fresh air introducing hole 24 is provided to be opened on the main port 18.

On the lower side (surface) of the main port 18, an installation hole 25 for attaching an installation member 49 of the air flowmeter (not shown) is perforated. The air flowmeter can be easily mounted in the cleaner case 10 by the provision of a fixing member 49 of the air flowmeter in the cleaner case body 11A.

Thus in the cleaner case 10, the air cleaner case 15 and the blowby room 20 are arranged in a longitudinal direction by dividing the inside of the peripheral wall 12 by the partition 13. By combining this arrangement with the main port being monolithically formed to pass through within the blowby room 20, a unit provided with the air cleaner case 15 controlling in the height and the longitudinal length and the blowby room 20 is compactly formed.

The cleaner case body 11A and the case cover 11B, which constitute the cleaner case 10, can be easily and inexpensively prepared by monolithic molding of good moldable resin. Further the molding is more easily performed and the mold can be compacted and rendered the form simple whereby the production cost can be reduced by the following process: separately molding in advance a monolithically molded product consisting the air cleaner case 15A, the lower portion 20A of the blowby room and the lower portion 16A of an air inlet and the connecting part 28, and then bonding them each other by a ultra sonic welding to prepare the cleaner case body 11A.

Figure 13:
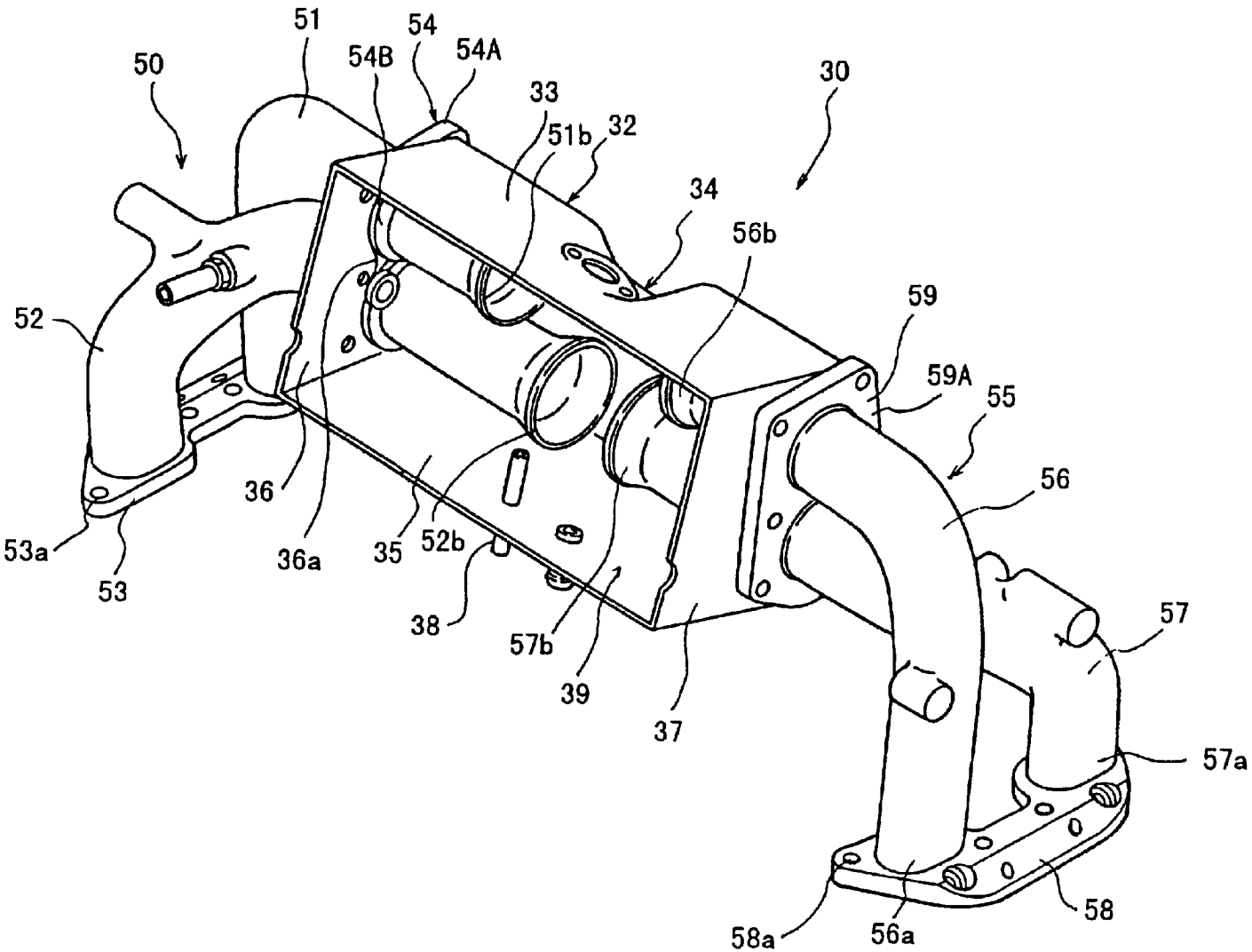
FIG. 13 is the oblique view of the condition incorporating the intake elements into the manifold.

On the other hand, the manifold 31 has the throttle box body 32 and a bay (partition) wall 40. The throttle box body 32 is composed of the upper side 33, the front side 34, the lower side 35 and both the sides 36, 37, and has a box shape opening at the rear side, with an installation opening 36*a* being opened on both the sides 36, 37 (an installation opening formed on the side 37 not shown), as the section view is shown in FIG. 5 and an oblique view of the condition attaching the intake elements 50, 55 mentioned later to it is shown in FIG. 13. Further, a hole 38 for introducing blowby gas is extruded in the form of pipe on the center part of the lower portion 35.

Figure 14:
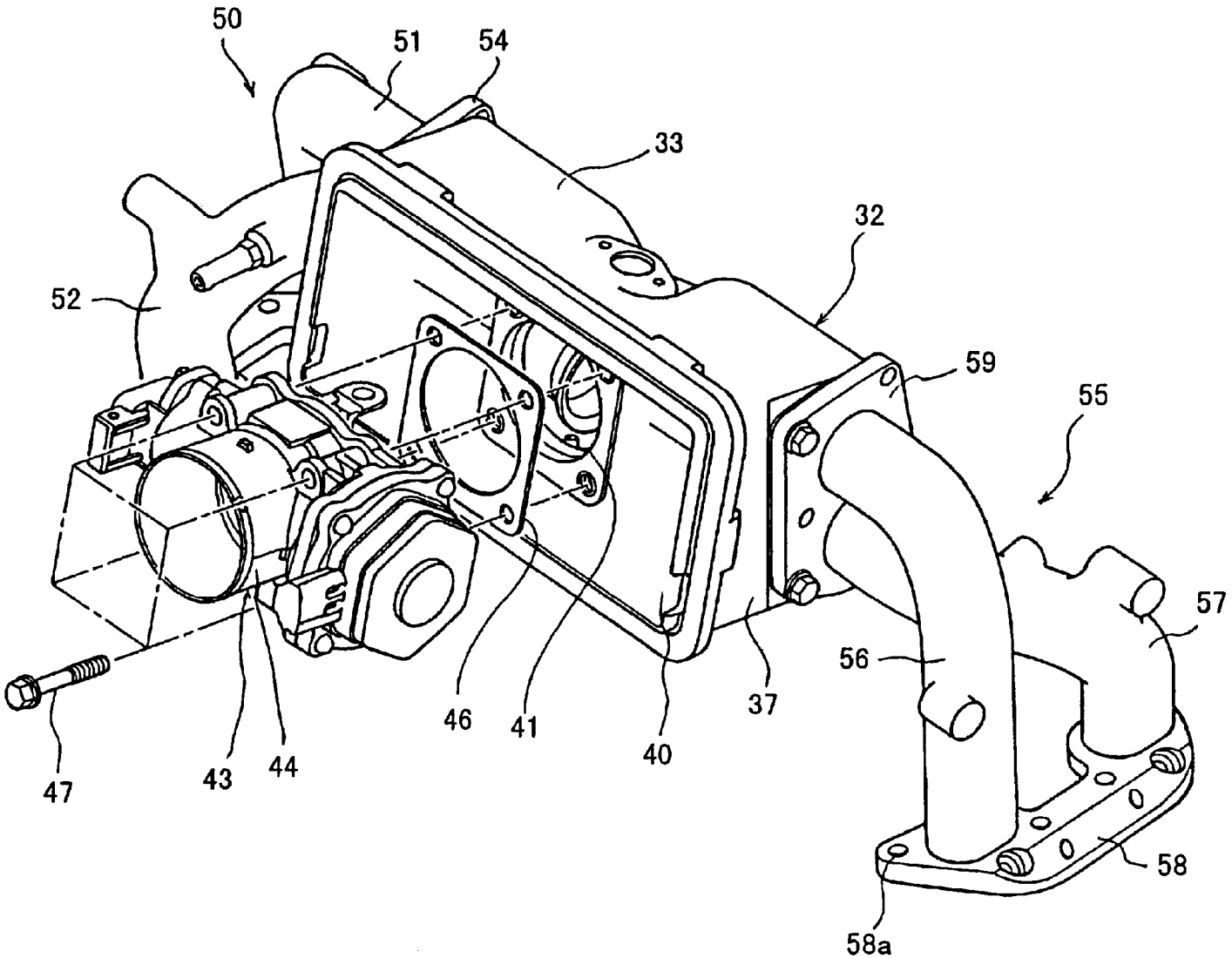
FIG. 14 is the oblique view of the condition connecting the throttle to the manifold.

The bay wall 40 has such a shape that it is inserted in an opening portion 39 opened on the rear side of the throttle box body 32 to block (intervene) the throttle box body 32 as shown in FIGS. 5 and 14. Further, on the central part of the bay wall 40, an installation hole 41 of the throttle is opened, and an end of a throttle body 44 of the throttle 43 is mounted on the fixing hole 41 of the throttle by a fixing member 46 and fixing bolts 47.

An end of the connecting part 28 formed on the cleaner case body 11A is joined to the opening portion 39 of the throttle box body 32 and connected by clips (not shown). Further the other end of the throttle body 44 is connected to the end of the main port 18 by a connecting member 48 in the form of pipe. By the connection of the manifold 31 and the main port 18, the filter element 19 arranged in the air cleaner case 15, the main port 18 and the throttle 43 are substantially horizontally arranged on essentially the same axis, which generally extends in the longitudinal direction of the vehicle body. In more detail, the intake route of linking the throttle 43 including the main port 18 to the filter element 19 is linearly arranged on an extension of the center axis S of the throttle 43, and the upper surfaces of the manifold 31, the connection part 28, the blowby room 20 and the air cleaner case 15 are continuously formed at substantially the same height.

Figure 15:
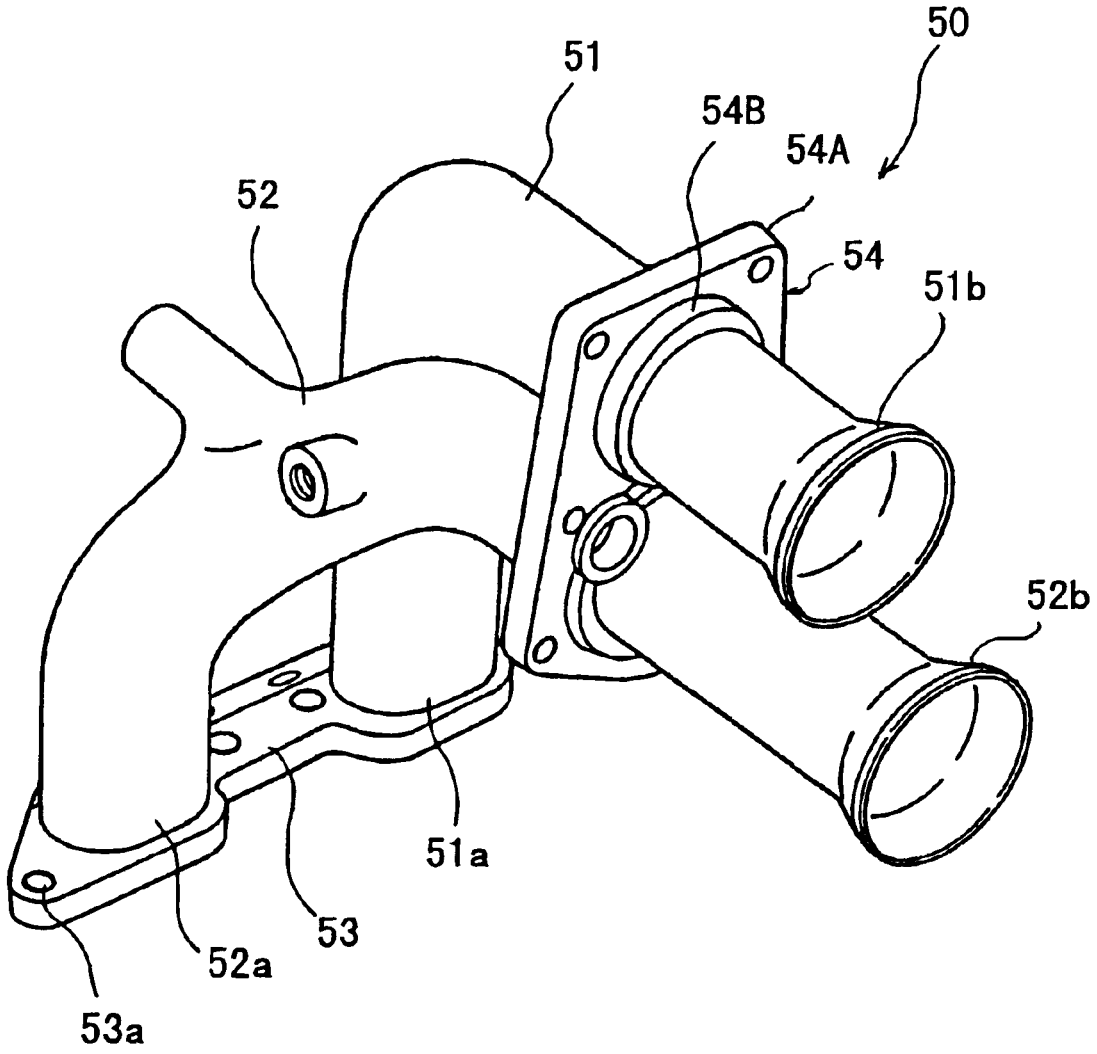
FIG. 15 is the oblique view of the intake element according to the present invention
Figure 16:
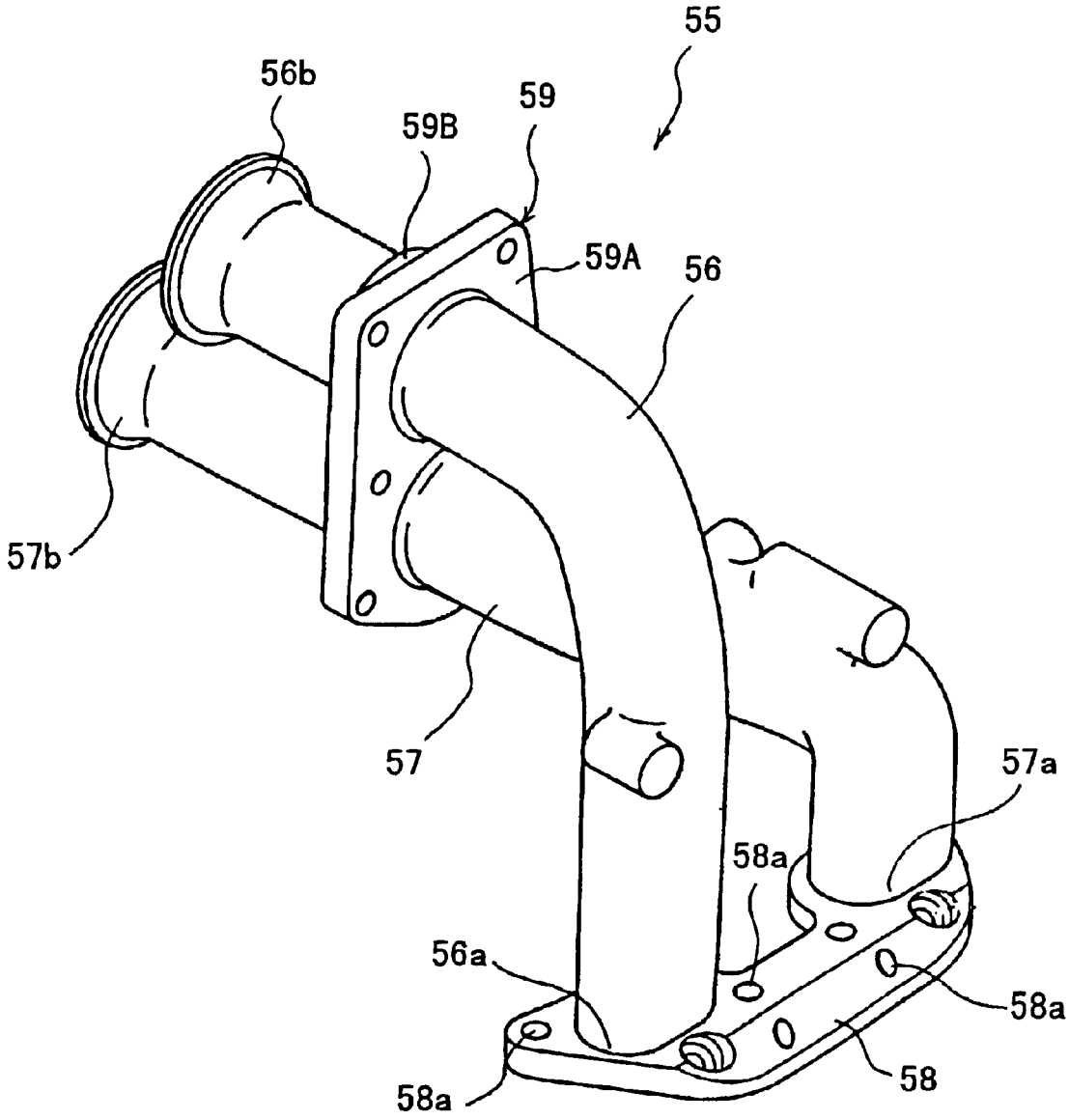
FIG. 16 is the oblique view of another intake element.

Each of the intake elements 50 and 55 are connected to each of both the side surfaces 36 and 37 of the throttle box body 32. The intake element 50 mounted on the side surface 36 is explained by reference to the oblique view given by incorporating into the throttle box body 32 (FIG. 13) and the oblique view of the intake element 50 (FIGS. 15 and 16).

The intake element 50 is made up of metal such as an aluminum alloy or a resin, which has excellent heat resistance, it is obtained by monolithically casting (e.g., die-casting) or molding a resin to form a pair of intake pipes 51, 52, an installation flange 53 on the downstream side and an installation flange 54 on the upstream side. The installation flange 53 on the downstream side is provided for connecting ends 51*a*, 52*a* on the downstream side of the intake pipes 51,52 to each other and connecting itself to an intake port of an engine 70. The installation flange 54 on the upstream side is provided for connecting the ends 51*b*, 52*b* on the upstream side of the intake pipes 51, 52 to each other and connecting itself to the side 36.

The intake pipes 51, 52 are formed so as to curve downward such that it is descended from the installation flange 54 on the upstream side which forms a part connecting to the throttle box body 32 to the installation flange 53 on the downstream side.

The installation flange 53 on the downstream side is formed on the upper side of the engine 70, and is made long longitudinally so as to come from upside into contact with a fixing surface on which the intake port opens, and further, on the installation flange 53, plural holes 53*a* for bolts for connecting to the engine 70 by the bolts are perforated, and furthermore, the end 51 a on the downstream side of the intake tube 51 is arranged and connected in the front side of the end 52*a* on the downstream side of the intake tube 52 such that each of them corresponds to each of the intake ports.

The installation flange 54 on the upstream side has an installation flange body 54A of which peripheral portion comes from outside into contact with the side surface 36 of the throttle box body 32 along a periphery of the installation opening 36*a*, and an inserting part 54B, which is protruded on the installation flange body 54A, for inserting in the installation opening 36*a*. Further, the intake tube 52 is arranged under the intake tube 51, and connected at the vicinity of the ends 51*b*, 52*b* on the upstream side of the intake pipes 51, 52.

The ends 51*b*, 52*b* on the upstream side of the intake pipes 51, 52 are protruded from the installation flange 54 on the upstream side such that the ends 51*b*, 52*b* are parallel to each other in the manifold 31 and the intake tube 52 is arranged under the intake tube 51, and are opened in a bell mouthed form to reduce air resistance of intake air. The end 52*b* on the upstream side of the intake tube 52 is set to be more largely protruded from the installation flange 54 on the upstream side into the manifold 31 compared with the end 51*b* on the upstream side of the intake tube 51, and to be curved in the form of bay downward, whereby effective tube lengths of the intake pipes 51, 52 are substantially the same as each other.

On the other hand, in the intake element 55 provided on the side of the side surface 37, as shown in FIG. 13, each of the intake pipes 56, 57 is connected to each of the ends 56*a*, 57*a* on the downstream side of the intake pipes 56, 57, and the installation flange 58 on the downstream side for connecting to the intake port of the engine 70 is connected to the vicinity of the ends 56*b*, 57*b* on the upstream side of the intake pipes 56, 57. In the combination with the above connecting procedures, the installation flange 59 on the upstream side for connecting to the side surface 37 is monolithically formed.

The installation flange 58 on the downstream side is made long longitudinally so as to come from the upside into contact with a fixing surface on which the intake port of the engine 70 opens, and on the installation flange 58, plural holes 58*a* for bolts for connecting to the engine 70 by the bolts are perforated, and furthermore, the end 57*a* on the downstream side of the intake tube 57 is arranged and connected in the front side of the end 56*a* on the downstream side of the intake tube 56 such that the pipes 56, 57 are longitudinally (in front and in rear) away from each other and such that each of them corresponds to each of the intake ports.

On the other hand, the installation flange 59 on the upstream side has an installation flange body 59A of which peripheral portion is in contact with the side surface 37 of the manifold along a periphery of the installation opening, and a inserting part (not shown), which is protruded on the installation flange body 59A, for inserting in the installation opening. Further, the intake tube 56 is arranged under the intake tube 57, and the vicinity of the ends 56*b*, 57*b* on the upstream side of the intake pipes 56, 57 is connected to the installation flange 59.

The ends 56*b*, 57*b* on the upstream side of the intake pipes 56, 57 are protruded from the installation flange 59 on the upstream side such the intake pipes 56, 57 they are parallel to each other in the manifold 31 and the intake tube 57 is arranged under the intake tube 56, and are opened in the bell mouthed form. The end 57*b* on the upstream side of the intake tube 57 is set to be more largely protruded from the installation flange 59 on the upstream side into the manifold 31 compared with the end 56*b* on the upstream side of the intake tube 56, and effective tube lengths of the intake pipes 56, 57 are set to be substantially the same as each other.

Each of the ends 51*b*, 52*b* on the upstream side of the intake pipes 51, 52 of the intake element 50 are opened opposite to each other in the manifold 31, and similarly the ends 56*b*, 57*b* on the upstream side of the intake pipes 56, 57 of the intake element 55 are opened opposite to each other in the manifold 31. Further, the throttle 43 is provided in the bay wall 40 such that a center axis S of the throttle is arranged substantially horizontally, and in a center in the vertical direction between the ends 51*b* and 52*b* and between the ends 56*b* and 57*b* on the upstream side of the intake pipes 51, 52, 56, 57 and extended to a center between the ends 51*b* and 56*b* and between the ends 52*b* and 57*b* on the upstream side opposite to each other.

In more detail, an induced air is horizontally led linearly from the cleaner case 10 through the main port 18 and throttle 43 to be introduced smoothly under the condition of a small intake resistance. In the manifold 31, a distance between the throttle 43 and each of the ends 51*b*, 52*b*, 56*b* and 57*b* on the upstream side of the intake pipes 51, 52, 56, 57 is set to a constant value. Further, the induced air to each of the cylinders of the horizontally opposed four-cylinder engine is, for instance, repeated in the order of the intake pipes 51, 52, 56, 57 to generate a turning flow, whereby an occurrence of turbulence is controlled to effectively avoid an interference effect of intake cylinder and to evenly provide the intake air into the intake pipes 51, 52, 56, 57.

A connection of the manifold 31 and the intake element 50 is easily carried out by inserting the ends 51*b*, 52*b* on the upstream side of the intake pipes 51, 52 from the outside into the installation opening 36*a* opened on the side surface 36 of the throttle box body 32, and simultaneously inserting the inserting part 54B of the installation flange 54 into the installation opening 36*a*, and further pressing the installation flange body 54A to the side surface 36 to melt and bond them by the ultra sonic welding of applying vibration. Similarly, bonding of the manifold 31 and the intake element 55 is easily carried out by inserting from outside the ends 56*b*, 57*b* on the upstream side of the intake pipes 56, 57 into the installation opening of the side surface 37, and simultaneously inserting the inserting part 59B of the installation flange 59 into the installation opening, and further pressing the installation flange body 54A to the side surface 37 to melt and bond them by the ultra sonic welding of applying vibration. Also in case the throttle box body 32 and the intake elements 50, 55 are prepared from different materials from each other, they can be easily and firmly bonded by ultrasonic welding. Further, the side surfaces 36, 37 of the manifold 31 are enforced by the intake elements 50, 55 having rigidity, and therefore requirement of rigidity to the manifold 31 is reduced to extend freedom of design.

Moreover, since the intake elements 50 and 55 are separately prepared, each of the intake elements is formed in relatively compact whereby the mold for preparation can be minimized to reduce the production cost.

Further, the intake elements 50 and 55 are prepared in the same form as each other, and therefore it is possible that one is mounted as it is on the side surfaces 36, 37 of the throttle box body 32 and the other is mounted in inversion. In this case, one kind of intake element can be used in both the intake elements 50 and 55, which brings about common use of the mold for the preparation to reduce the production cost and which provides reduction of the kinds of different constituent members to improve the productivity. Furthermore, since the intake elements 50 and 55 are connected to the throttle box body 32, the intake element (not shown) having a different shape is connected to the sides of the manifold 31 depending upon requirement of performance of the engine or the like. In other word, one kind of the manifold 31 and cleaner case 10 can be used in various engines. In addition, since the intake elements 50 and 55 are connected to both the side surfaces 36, 37 opposite to each other of the manifold 31, which is mounted and supported on the engine through the intake elements 50 and 55, the manifold 31 and further the intake system 10 can be held stably.

A reflux system of the blowby gas is explained by reference of the oblique view of FIG. 17 and schematic view of FIG. 18.

Figure 17:
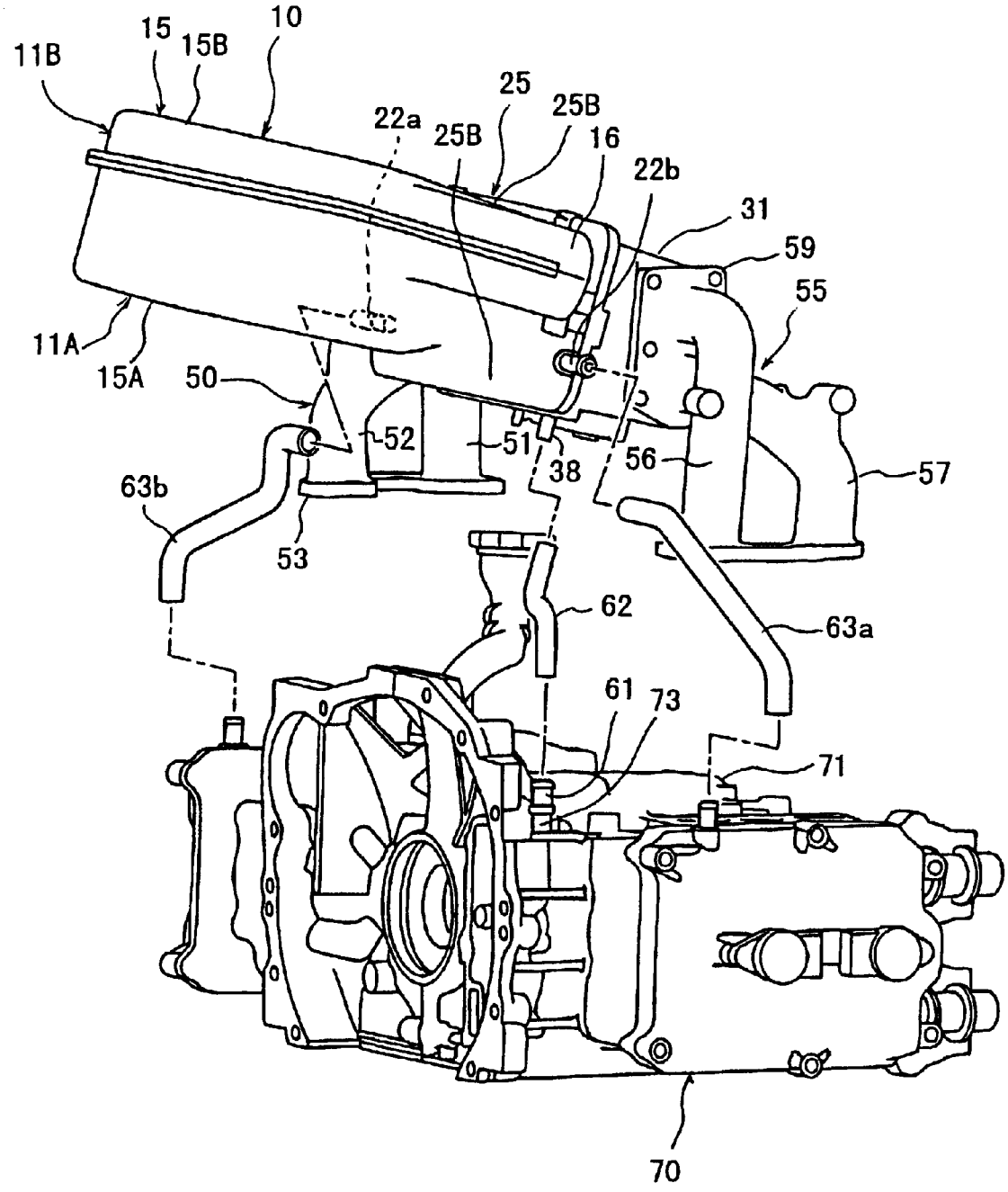
FIG. 17 is the oblique view showing an outline of the reflux system of a blowby gas.
Figure 18:
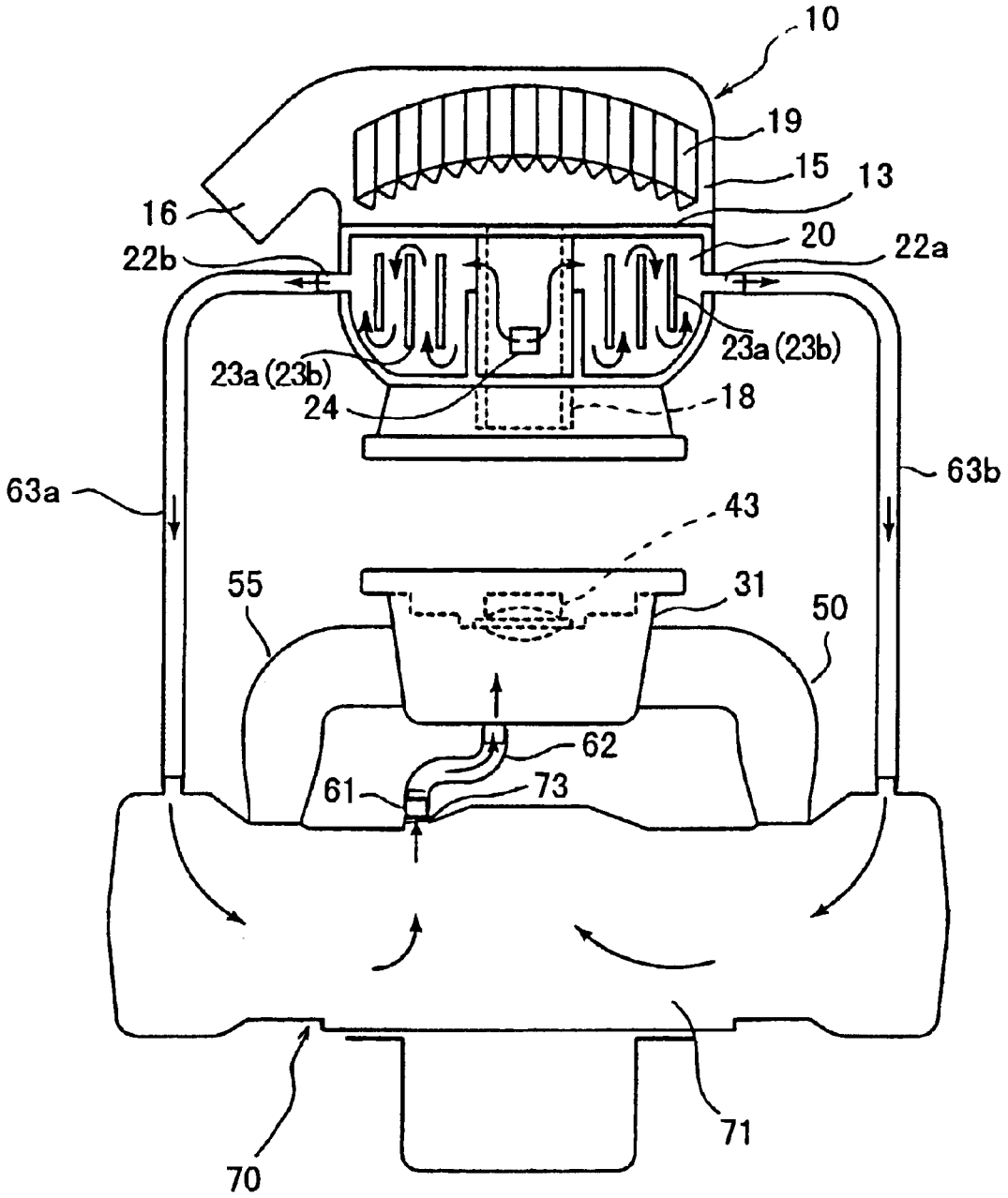
FIG. 18 is a schematic view showing an outline of the reflux system of the blowby gas.

As shown in FIG. 17, a feeding hole 73 of the blowby gas formed on the center portion of the upper side of a crank case 71 and a blowby gas introducing hole 38 formed on the throttle box body 32 are linked to each other by a blowby hose 62 through a PCV valve 61, and the crank case 71 of the engine 70 and the connecting holes 22*a*, 22*b* opened on both the sides of the lower portion 20A of the blowby room are linked to each other by fresh air hoses 63*a*, 63*b*.

In the reflux system of the blowby gas formed as above, as shown in FIG. 17, the insides of the crank case 71 and manifold 31 are linked to and passed through each other by the PCV valve 61 and the blowby hose 62, and therefore the blowby gas leaked out of a clearance between a piston and a cylinder wall into the crank case 71, i.e., the amount of the blowby gas depending upon an intake pressure of the intake system (i.e., negative pressure in the manifold 31) is recycled into the manifold 31, and then the blowby gas is fed to the intake port together with the fresh air introduced at the throttle 43 from the manifold 31 through the intake elements 50, 55 to be burned again.

On the other hand, fresh air in the air cleaner case 15 is introduced into the blowby room 20 at a fresh air introducing hole 24 opened on the main port 18, moisture and foreign matters are separated by separators 23*a*, 23*b* formed in the form of labyrinth in the blowby room 20 and simultaneously pulsate is controlled whereby the fresh air is fed to the crank case 71 from the connecting holes (discharge holes) 22*a*, 22*b* through fresh air hoses 63*a*, 63*b*. Hence, the inside of the crankcase 71 is kept at an atmospheric pressure and ventilated. Further, it is possible to prevent the blowby gas from deterioration of the engine oil. The fresh air introducing hole 24 may be perforated on the partition 13 instead of the main port 18 so as to link and pass through between the lower portion 15A of air cleaner case and the lower portion 20A of the blowby room 20.

The intake system having the above construction, brings about the following effects (I) and (II).

(I) (In the First to Third Inventions):

According to the intake system having the above construction, the introduction of air is carried out substantially horizontally to the manifold 31, and therefore the height of the manifold 31 can be lowered without provision of the throttle over the manifold 31, and further an arrangement from the throttle 43 through the main port 18 to the filter element 19 in the air cleaner case 15 is rendered substantially horizontal and linear, whereby the height of the cleaner case 10 is easily and substantially the same as that of the manifold 31 and the duct connecting between the manifold 31 and the cleaner case 10 can be removed. Hence, it is possible that the intake system is made compact.

In addition, the division of the inside of the hollow cleaner case 10 by the partition 13 permits the monolithic formation of the air cleaner case 11 and the blowby room 20, and therefore it is possible to render the ducts for connecting between the air cleaner case 11 and the blowby room 20 and between the cleaner case 10 and the manifold 31 disused and to compactly form the intake system 1 (especially in the second invention).

Further, the inside of the hollow formed by the cleaner case body 11A and the case cover 11B is divided by the partition 13 into the air cleaner case 15 and the blowby room 20 which are monolithically formed so as to adjoining each other longitudinally, and the main port 18 is monolithically formed to pass through the blowby room 20. Hence, the height and longitudinal length thereof are reduced, as a result the air cleaner 15, the blowby room 20 and the main port 18 are monolithically formed compactly to connect the cleaner case prepared as a unit to the manifold assembly 30 obtained as a unit by connecting the intake elements 50, 55 to the side surfaces 36, 37 of the manifold 31. Thereby the intake system 1 is formed as a unit and can be compactly mounted on the engine 70, which improves efficiency of the mounting operation. Furthermore, the air cleaner case 15, the blowby room 20 and the manifold 31 are longitudinally extended to be arranged continually, whereby a dimension in the height direction can be decreased to ensure sufficiently clearance L between the hood 80 and the intake system 1 as shown in FIG. 2.

Moreover, the main portion of the intake system comprising the air cleaner case 15, the blowby room 20 and the throttle 43 such as the manifold 31 and excluding the intake elements 50, 55 are made up of the resin, and therefore the main portion having a light weight easily prepared to reduce the production cost, and further rationalizes collection of functions of the intake system 1. Hence, it is easily used for other kinds of vehicles having different shape and effective space of the engine, i.e., widely used, and it becomes easy to modularize the intake system 1.

Further, in case a pedestrian applies impact load onto the hood 80, a crush stroke of the hood 80 is ensured and also the absorption or reduction of the impact energy by the deformation of the hood 80 can be obtained. Moreover, the case body 11A, case cover 11B and manifold 31 of the intake system 1 with which the hood is brought into contact are formed from relatively elastic resin, whereby the safety for the pedestrian is enhanced. Furthermore, the hood can be lowered, i.e., the slant nose can be adopt, whereby the visibility of a driver and the reduction of running the resistance can be expected and the design freedom of vehicle body is extended.

(II): (In the Fourth Invention):

According to the intake system, the manifold 31 and the intake elements 50, 55 are separately formed in advance, and then these are monolithically connected to be bonded. Therefore, the manifold 31 and the intake element 55 can be set without interaction thereof, and the freedom of design of the shapes of the manifold 31 and the intake elements 50, 55 cam be ensured, and consequently the manifold 31 and further the intake system can be compacted.

Further, by substituting the intake elements 50, 55 by another one depending upon variation of specification of the engine, the intake system can be used in various engines, and therefore the manifold 31 and the cleaner case 10 can be used in common, i.e., can be easily modularized.

Furthermore, the cleaner case 10 is arranged at substantially the same height as the manifold 31, and these are connected to each other, whereby the intake system 1 can be rendered compact. The manifold 31 and the cleaner case 10 each are monolithically molded from the resin having excellent molding properties and capable of providing a light molded product, whereby the production cost can be reduced.

As a result, clearance L between the hood 80 and the intake system 1 can be sufficiently ensured as shown in FIG. 2, and further the manifold 31 and the cleaner case 10, which may contact the hood by its deformation when a pedestrian contacts the hood to apply impact load onto the hood, is formed from a relatively flexible resin, whereby the safety to pedestrian is improved. In addition, the intake system 1 has a feature that the system 1 can be prepared in the compact form, and therefore it can be easily provided in other kinds of the vehicle in which the shape or the effective space is restricted and therefore the modularity is facilitated.

The ends on the upstream side of the intake elements 50, 55 are connected to the installation opening 36*a*, 37*a* opened on the side surfaces 36, 37 of the manifold 31 and curvedly formed downward from said connected point, and further the ends on the downstream side of the intake elements are mounted on the engine 70. Hence, the space between the manifold 31 and the engine 70 can be reduced and an effective length of the intake elements 50, 55 can be ensured.

The description as to the effects (I) and (II) is concluded here.

Second Embodiment

Figure 19:
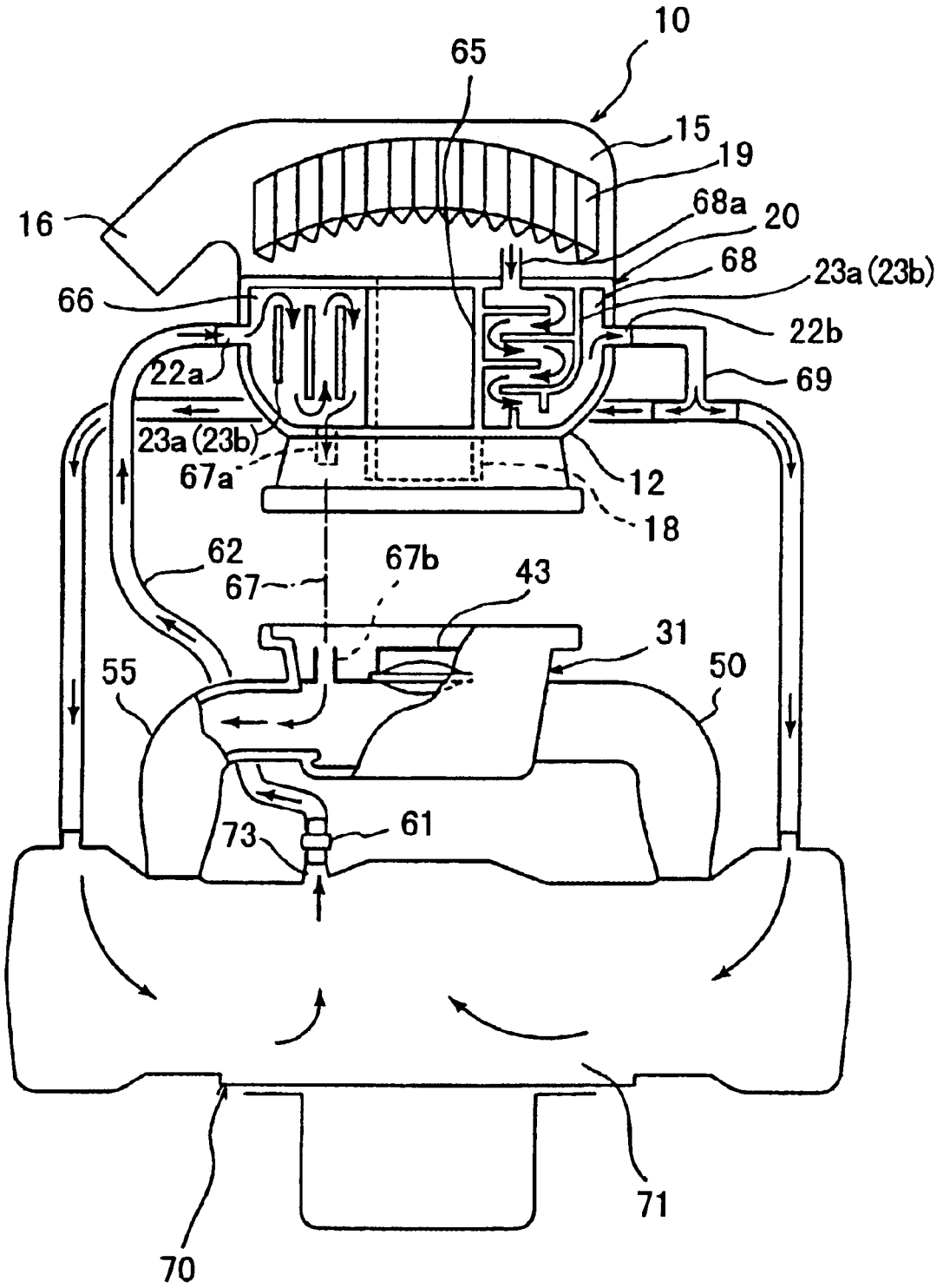
FIG. 19 is the schematic view of the reflux system of the blowby gas showing an outline of a second embodiment of the intake system of engine.

A second embodiment is explained based on FIG. 19. Of the reference numbers shown in FIG. 19, the elements corresponding to those in FIGS. 1 to 18 are marked to have the same numbers with no detail explanation. The reference numbers not shown in FIGS. 1 to 18 are mainly explained.

FIG. 19 is a schematic view of the reflux system of the blowby gas corresponding to FIG. 17, and the inside of the blowby gas 20 is divided by the partition wall 65 into a first blow by room 66 and a second blowby room 68.

The first blowby room 66 is passed through the crank case 71 by linking a feeding hole 73 of a blowby gas formed in the crank case 71 with the connecting hole 22*a* by a blowby hose 62 having PCV valve 61 in the way, and it is passed through the manifold 31 by a blowby hose 67 linking a feeding hole 67*a* of the blowby gas opened on the peripheral wall 12 with an introducing hole 67*b* of the blowby gas opened on the partition wall 40.

The second blowby room 68 is passed through the air cleaner case 15 by the hole 68*a* for introducing the fresh air perforated on the partition 13, and passed through the crank case 71 by a fresh air hose 69 of which one end is connected to the connecting hole 22*b* and of which other end is branched to be connected to the crank case 71.

Further, the blowby gas leaked out of the clearance between the piston and the cylinder wall into the crank case 71 is introduced into the first blowby room 66 from the connecting hole 22*a* through the PCV valve 61 and the blowby hose 66, as a result, foreign matters such as oil and moisture is separated by separators 23*a*, 23*b* and simultaneously the pulses are controlled. Thereby, the blowby gas 20 is recycled from the blowby hose 67 into the manifold 31, and further is fed to the intake port together with the fresh air introduced at the throttle 43 from the manifold 31 through the intake elements 50, 55 to be burned again.

On the other hand, the fresh air is fed to the second blowby room 68 from the air cleaner case 15 through the fresh air introducing hole 68*a*, separation of foreign matters such as moisture and dusts and control of pulses being carried out by the separators 23*a*, 23*b* formed in the form of a maze within the second blowby room 68, and the fresh air is further fed to the crank case 71 of the engine 70 from the discharge hole 22*b* through the fresh air hose 69 to keep the crank case 71 at the atmospheric pressure and ventilative. Moreover, the fresh air introducing hole 68*a* can be formed on the main port 18 in the same manner as the first embodiment instead of the partition 13.

Third Embodiment

Figure 20:
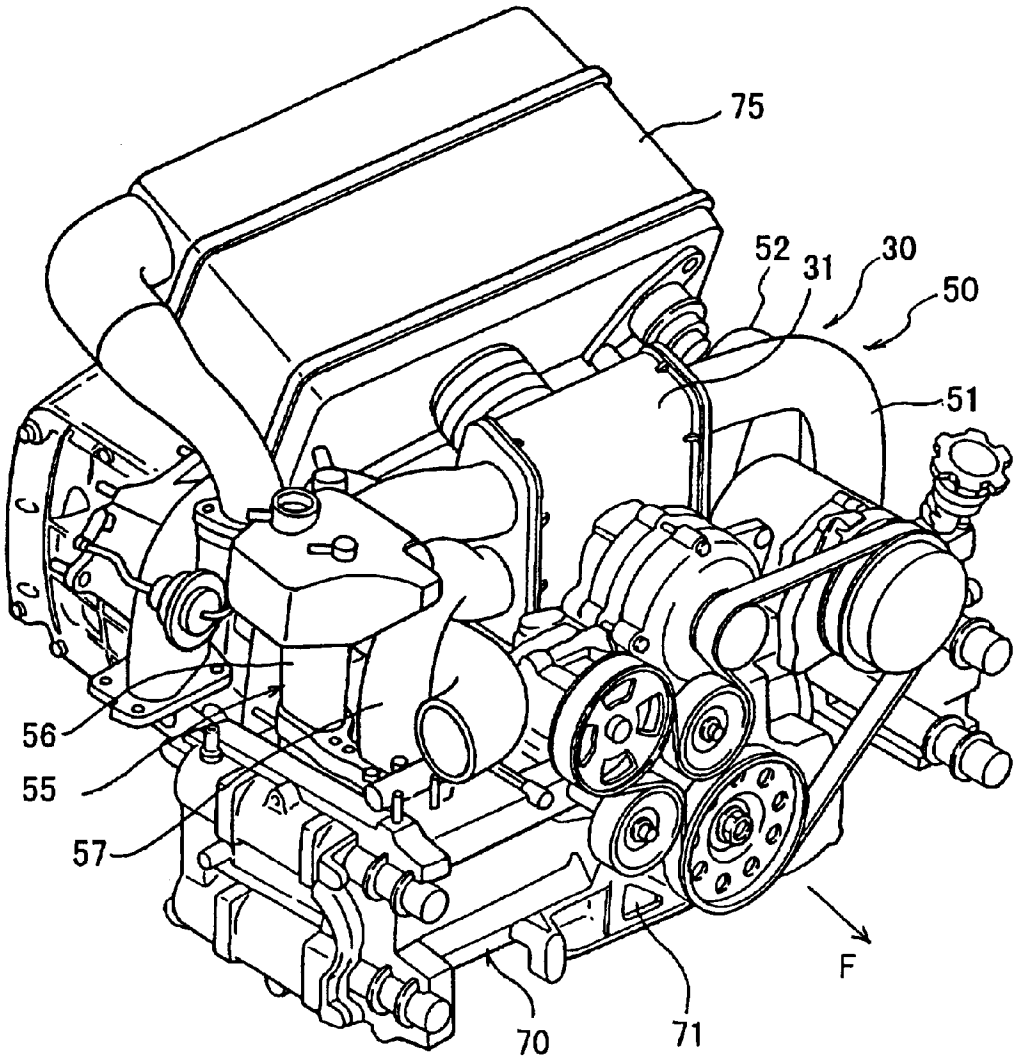
FIG. 20 is a whole schematic view showing the condition given by mounting the intake system on the engine, which shows an outline of a third embodiment of the intake system of the engine.
Figure 21:
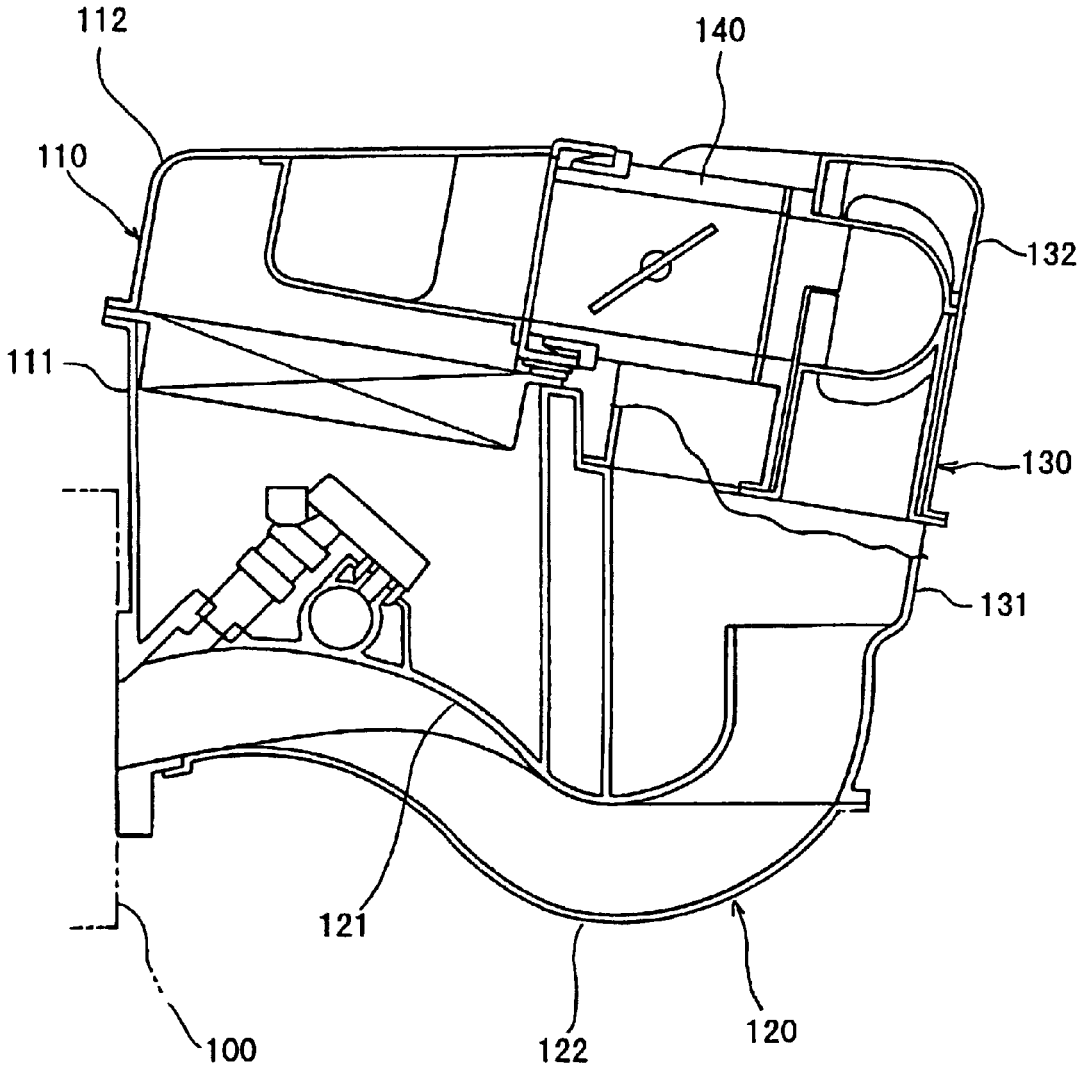
FIG. 21 (PRIOR ART)
FIG. 21 (prior art) is a side view showing an outline of a conventional air intake system.
Figure 22:
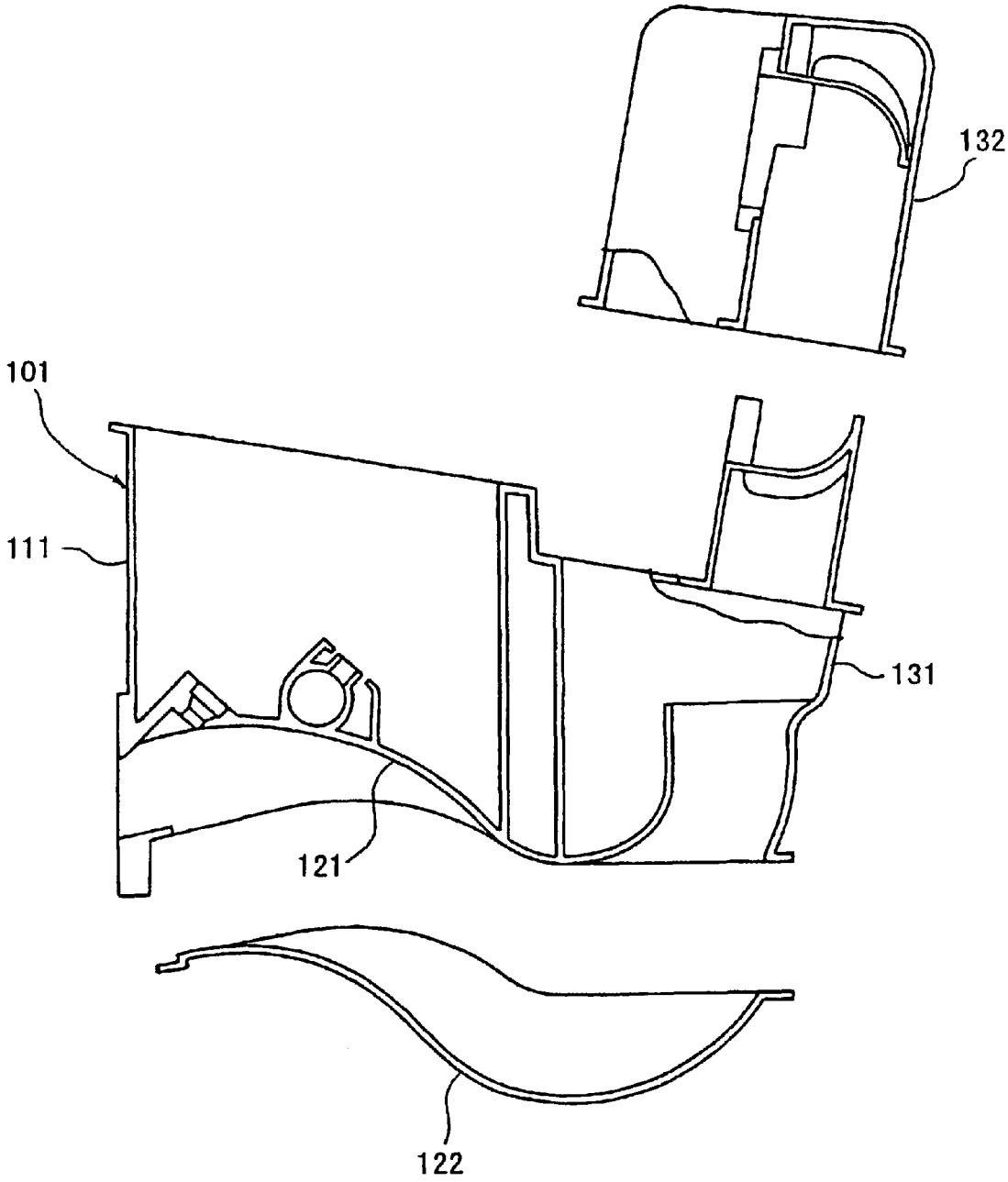
FIG. 22 (PRIOR ART)
FIG. 22 (prior art) is an oblique deal view of the outline of the conventional intake system.
Figure 23:
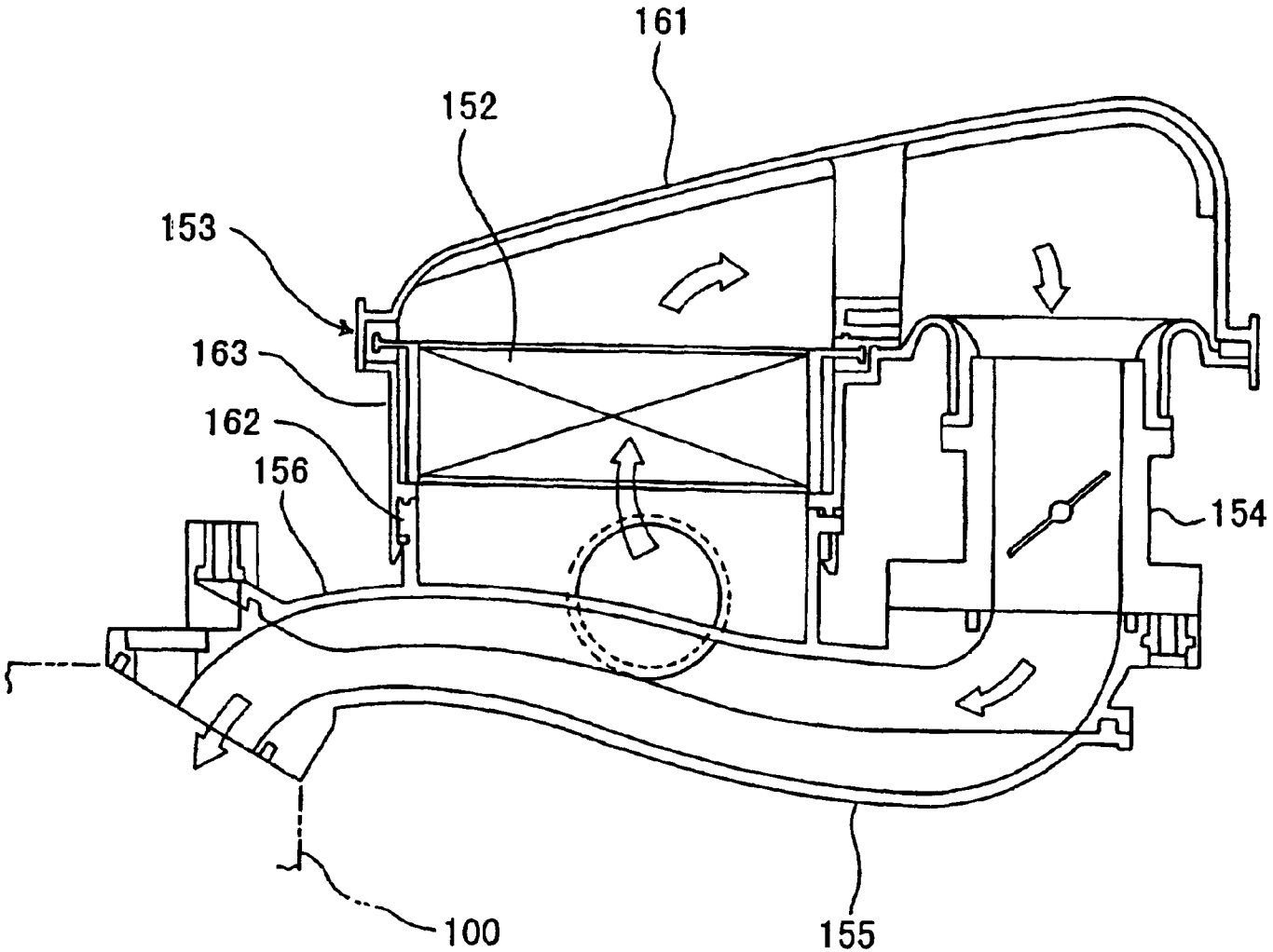
FIG. 23 (PRIOR ART)
FIG. 23 (prior art) is a side view showing an outline of another conventional intake system.

A third embodiment is explained based on FIG. 20. FIG. 20 is a whole schematic view showing an outline of an intake system of a turbo engine. Of the reference numbers shown in FIG. 20, the elements corresponding to those in FIGS. 1 to 18 are marked to have the same numbers as those in FIGS. 1 to 18 with no detail explanation. The reference numbers not shown in FIGS. 1 to 18 are mainly explained.

In the same manner as the first embodiment, the manifold 31 is mounted on the upside of the engine 70 through the intake elements 50, 55. On the throttle 43 mounted on the bay wall 40 of the manifold 31, the inter cooler 75 in the form of approximately a rectangular box is arranged instead of the cleaner case of the first embodiment at the approximately same height as the manifold 31, and the intake air fed through the air cleaner and super charged by a turbo charger (not shown) is cooled to be fed to the manifold 31 from the throttle 43, and further the fresh air is introduced into each of the intake ports of the engine 70 by the intake elements 50, 55.

The above-mentioned structure brings about the advantages that the manifold 31 and the manifolds 50, 55 of the first embodiment can be used in common and the height can be reduced because the manifold 31 and the inter cooler 75 are arranged at the approximately same height as each other whereby the height can be reduced.

The present invention should not be restricted by the above-mentioned embodiments. Further the invention can be varied in the structure so long as the variation is not deviated form the gist of the invention. For example, the invention can be also applied to a V-type engine though the explanation is carried out as to an instance of the horizontally opposed four-cylinder engine on the above embodiments. Further, the fixing member for air flowmeter 49 for supporting the air flowmeter is provided in the cleaner case body 11A, but it is possible to provide the fixing member for air flowmeter 49 on the case cover 11B.

Effects of the invention are collected (summarized) and described as follows:

According to the first invention, in the intake system of the engine which introduces the fresh air passed through the cleaner case having the filter element therein into the manifold through the throttle, and distributes the air from the manifold to each cylinders by an intake element, the throttle is provided in the manifold such that the center axis of the throttle is provided substantially horizontally and in the center in the vertical direction between the ends on the upstream side of the intake pipes provided vertically and extended to the center between the ends on the upstream side opposite to each other provided on both sides of the manifold. Thereby, sufficient air intake efficiency can be ensured in each of the cylinders, and the air is introduced from side horizontally into the manifold, whereby the height of the manifold can be reduced and simultaneously the height of the cleaner case can be effectively reduced. Hence, the clearance between the hood and the intake system can be easily ensured, and therefore the impact energy can be sufficiently absorbed or relaxed by the deformation of the hood with safety to pedestrian being improved.

The manifold and the cleaner case can be mounted on the engine through the intake element as the sub-assembly unit, and therefore the production can be efficiently conducted, and the intake system is formed compactly, whereby the air intake system is easily mounted on other kinds of vehicles provided with the engine having a restricted form or effective-space, i.e., can be widely employed and the modularity is easily carried out.

According to the second invention, in the intake system of the engine which introduces the fresh air passed through the cleaner case having a filter element therein into the manifold through the throttle, and distributes the air from the manifold to each of cylinders of the engine by the intake element, the throttle is connected to the manifold such that the center axis of the throttle is arranged substantially horizontal and simultaneously the intake route of linking the throttle including the main port to the filter element is substantially arranged linearly on the center axis of the throttle, whereby the height of the box can be reduced, and further intake resistance in an intake route from the air cleaner to the throttle through the main port can be reduced.

Further, the clearance between the hood and the intake system can be easily ensured, and therefore the impact energy can be sufficiently absorbed or relaxed by the deformation of the hood with safety to pedestrian being improved.

The manifold and the cleaner case can be mounted on the engine through the intake element as the sub-assembly unit, and therefore the mounting operation can be efficiently conducted, and the intake system is formed compactly, whereby the intake system is easily mounted on other kinds of vehicles provided with the engine having a restricted form or effective-space, i.e., can be widely employed and the modularity is easily carried out.

According to the third invention, the inside of the cleaner case in the form of hollow is divided by the partition into the air cleaner case and the blowby room, and therefore both of the air cleaner case and the blowby room can be monolithically formed and compactified. Further the connection of the manifold to the cleaner case brings about compactification of the intake system.

Hence, in case the intake system of the present invention is mounted in the engine room, the clearance between the hood and the intake system can be sufficiently ensured, and therefore the impact energy can be sufficiently absorbed or relaxed by the deformation of the hood with safety to pedestrian being improved.

Further, the manifold and the cleaner case can be mounted on the engine through the intake element as the sub-assembly unit, and hence the production can be efficiently conducted, and the intake system is formed compactly, whereby the intake system is easily mounted on other kinds of vehicles provided with the engine having a restricted form or effective-space, and the modularity is easily carried out According to the fourth invention, in the air intake system of the engine which introduces the fresh air passed through the cleaner case having the filter element therein into the manifold through the throttle, and distributes the air from the manifold to each of cylinders by the intake element, the manifold and the intake element are separately formed in advance and then are monolithically connected to each other. Thereby, the manifold and the intake element can be designed without considering influences therebetween, that is, the design freedom of the manifold and the intake element is ensured to permit compactification of the manifold and further compactification of the intake system.

Hence, clearance between the hood and the intake system can be easily ensured, and the impact energy can be sufficiently absorbed or relaxed by the deformation of the hood with safety to pedestrian being improved.

Further, with compared to the monolithic molding of the manifold and the intake element, the intake system of the invention permits simplification and compactification of the shape to facilitate the molding, and simultaneously to bring about miniaturization of the mold therefor and reduction of the production cost.

Furthermore, by substituting the intake element by another one depending upon variations of the engine specification, the intake system of the present invention can be used for various engines, and therefore the manifold can be used in common, i.e., can be modularized.

We claim:

1. An air intake system of an engine for introducing air passed through a cleaner case having a filter element therein into a manifold through a throttle, and distributing the air from the manifold to each cylinder of the engine by an intake element, comprising:

both sides of the manifold opposite to each other wherein the manifold is mounted on an upper side of the engine through the intake element, the cleaner case being connected to the manifold, plural intake pipes provided side by side and vertically to both of the sides of the manifold opposite to each other in the intake element, each end on an upstream side of the intake pipes being opened and each end on a downstream side of the intake pipes connecting to each of intake ports of the engine, and a center axis of the throttle in the manifold being substantially horizontal and centered in the vertical direction between the ends on the upstream side of the intake pipes extended to a center between the ends on the upstream side opposite to each other provided on both sides of the manifold.

2. The air intake system of the engine as defined in claim 1, wherein:

the cleaner case has an air cleaner case having the filter element therein and a main port leading air from the air cleaner case to the throttle, and an intake route linking the throttle including the main port to the filter element is linearly arranged on an extension line of the center axis of the throttle.

3. The air intake system of the engine as defined in claim 1, wherein the cleaner case has;

a cleaner case body molded monolithically from a resin which has a lower portion of an air cleaner case opened upper side thereof with the filter element therein and which has a lower portion of a blowby room opened upper side thereof and divided into each other by a partition;

a case cover molded monolithically from a resin, which has the upper portions of the air cleaner case and blowby room which cover the upside of the lower portions of the air cleaner case and the blowby room, the cleaner case being a hollow cleaner case and including the lower and upper portions of the air cleaner case into which the filter element is incorporated and which is formed by combining the cleaner case body to the case cover, and the blowby room is formed from the lower and upper portions of the blowby room, which constitute a blowby gas reflux system.

4. The air intake system of the engine as defined in claim 3, wherein the cleaner case body is molded monolithically such that the main port, which leads air from the inside of the air cleaner case to the throttle through the lower portions of the air cleaner and the blowby room, is further incorporated into the cleaner case body.

5. The air intake system of an engine as defined in claim 3, wherein a fixing member for supporting an air flowmeter is provided on the cleaner case body or the case cover.

6. The air intake system of the engine as defined in claim 1, wherein the intake element is divided into a pair of intake manifolds each of which is connected to each of the sides of the manifold.

7. The air intake system of the engine as defined in claim 1, wherein an inter cooler is connected to the manifold at substantially the same height as the manifold instead of the cleaner case.

8. An air intake system of an engine which introduces air passed through a cleaner case having a filter element therein into a manifold through a main port and a throttle, and distributes the air from the manifold to each cylinder of the engine by an intake element, comprising:

the manifold mounted on an upper side of the engine through the intake element connected to the manifold, the cleaner case being connected to the manifold, and the throttle being connected to the manifold such that a center axis of the throttle is provided substantially horizontal, and an intake route, linking the throttle with the main port to the filter element, is linearly provided on an extension line of the center axis of the throttle.

9. The air intake system of the engine as defined in claim 8, wherein the cleaner case has;

a cleaner case body molded monolithically from a resin, which has a lower portion of air cleaner case opening its upper side and has the filter element therein and which has a lower portion of a blowby room opening its upper side which is divided into each other by a partition, a case cover molded monolithically from a resin, which has the upper portions of the air cleaner case and blowby room which cover the upside of the lower portions of the air cleaner case and the blowby room, the cleaner case is a hollow cleaner case which has the lower and upper portions of the air cleaner case into which the filter element is incorporated and which is formed by combining the cleaner case body to the case cover, and the blowby room is formed from the lower and upper portions of the blowby room, which constitute a blowby gas reflux system.

10. The air intake system of the engine as defined in claim 9, wherein the cleaner case body is molded monolithically such that the main port, which leads air from the inside of the air cleaner case to the throttle through the lower portions of the air cleaner and the blowby room, is further incorporated into the cleaner case body.

11. The air intake system of the engine as defined in claim 10, wherein a fixing member for supporting said air flowmeter is mounted on the cleaner case body or the case cover.

12. An air intake system of an engine which introduces air passed through a cleaner case having a filter element therein into a manifold through a throttle, and distributes the air from the manifold to each cylinder of the engine by an intake element, wherein the manifold is mounted on an upper side of the engine through the intake element connected to the manifold, the cleaner case, which is in the form of a hollow case, is connected to the manifold at substantially the same height as each other and obtained by monolithically molding both of an air cleaner case having the filter element divided by a partition therein and a blowby room constituting a blowby gas reflux system, wherein the cleaner case has;

a cleaner case body molded monolithically from a resin, which has a lower portion of air cleaner case opening the upper side and has the filter element therein and which has a lower portion of a blowby room opening the upper side which is divided into each other by a partition, a case cover molded monolithically from a resin, which has the upper portions of the air cleaner case and blowby room which cover the upside of the lower portions of the air cleaner case and the blowby room, the cleaner case is a hollow cleaner case which has the lower and upper portions of the air cleaner case into which the filter element is incorporated and which is formed by combining the cleaner case body to the case cover, and the blowby room is formed from the lower and upper portions of the blowby room, which constitute a blowby gas reflux system.

13. An air intake system of an engine which introduces air passed through a cleaner case having a filter element therein into a manifold through a throttle, and distributes the air from the manifold to each cylinder of the engine by an intake element, wherein the manifold is mounted on an upper side of the engine through the intake element connected to the manifold, the cleaner case, which is in the form of a hollow case, is connected to the manifold at substantially the same height as each other and obtained by monolithically molding both of an air cleaner case having the filter element divided by a partition therein and a blowby room constituting a blowby gas reflux system, wherein the blowby room comprises a first blowby room separating foreign matters from a fresh air fed from the air cleaner to a crank case of the engine and a second blowby room separating foreign matters from the blowby gas recycling between the crank case of the engine and the manifold, the first and second blowby rooms being divided by a parting wall.

14. An air intake system of an engine which introduces a fresh air passed through a cleaner case having filter element therein into a manifold through a throttle, and distributes the air from the manifold to each cylinder of the engine by an intake element, wherein the manifold and the intake element, which are separately formed in advance, are bonded to each other by monolithically connecting an installation opening which opens at the manifold to an end on an upstream side of the intake element, and an end on a downstream side of the intake element is mounted on an upper side of the engine, and the cleaner case is molded monolithically from a resin and connected to the manifold at substantially the same height as each other, wherein: the manifold has an installation opening which opens at a side of the throttle box, ends on the upstream side of the intake element are monolithically connected to the installation opening, and the intake element extends in a downwardly curved configuration from said connected point, and an end on the downstream side of the intake element is mounted on the engine.

15. An air intake system of an engine which introduces a fresh air passed through a cleaner case having filter element therein into a manifold through a throttle, and distributes the air from the manifold to each cylinder of the engine by an intake element, wherein the manifold and the intake element, which are separately formed in advance, are bonded to each other by monolithically connecting an installation opening which opens at the manifold to an end on an upstream side of the intake element, and an end on a downstream side of the intake element is mounted on an upper side of the engine, and the cleaner case is molded monolithically from a resin and connected to the manifold at substantially the same height as each other, and wherein the manifold is monolithically molded from a resin, and the intake manifold is monolithically cast from a metal or resin, or monolithically molded from the resin.

16. An air intake system of an engine which introduces air passed through a cleaner case having a filter element therein into a manifold through a throttle, and distributes the air from the manifold to each cylinder of the engine by an intake element, wherein the manifold is mounted on an upper side of the engine through the intake element connected to the manifold, the cleaner case, which is in the form of a hollow case, is connected to the manifold and obtained by monolithically molding both of an air cleaner case having the filter element divided by a partition therein and a blowby room constituting a blowby gas reflux system, and wherein the cleaner case further has;

a cleaner case body molded monolithically from a resin, which has a lower portion of air cleaner case opening the upper side and has the filter element therein and which has a lower portion of a blowby room opening the upper side which is divided into each other by a partition, a case cover molded monolithically from a resin, which has the upper portions of the air cleaner case and blowby room which cover the upside of the lower portions of the air cleaner case and the blowby room, the cleaner case is a hollow cleaner case which has the lower and upper portions of the air cleaner case into which the filter element is incorporated and which is formed by combining the cleaner case body to the case cover, and the blowby room is formed from the lower and upper portions of the blow by room, which constitute a blowby gas reflux system.

17. The air intake system of the engine as defined in claim 16, wherein the cleaner case is connected to the manifold at substantially the same height as each other.

18. The air intake system of the engine as defined in claim 16, where the cleaner case body is molded monolithically such that the main port, which leads air from the inside of the air cleaner case to the throttle through the lower portions of the air cleaner and the blowby room, is further incorporated into the cleaner case body.

19. The air intake system of an engine as defined in claim 16, wherein the blowby room comprises a first blowby room separating foreign matters from fresh air fed from the air cleaner to a crank case of the engine and a second blowby room separating foreign matters from the blowby gas recycling between the crank case of the engine and the manifold, the first and second blowby rooms being divided by a parting wall.

20. The air intake system of the engine as defined in claim 16, wherein a fixing member for supporting an air flowmeter is mounted on the cleaner case body or the case cover.

21. An air intake system of an engine which introduces fresh air passed through a cleaner case having filter element therein into a manifold through a throttle, and distributes the air from the manifold to each cylinder of the engine by an intake element, wherein the manifold and the intake element, which are separately formed in advance, are bonded to each other by monolithically connecting an installation opening which opens at the manifold to an end on an upstream side of the intake element, and an end on a downstream side of the intake element is mounted on an upper side of the engine, and wherein the throttle is mounted in the manifold such that a center axis of the throttle is substantially horizontal, and the cleaner case has the air cleaner case having the filter element therein and a main port leading air from the air cleaner case to the throttle, and an intake route of linking the throttle including the main port to the filter element is arranged linearly on an extension line of the center axis of the throttle.

22. The air intake system of the engine as defined in claim 21, wherein the cleaner case is molded monolithically from a resin such that it is connected to the manifold at substantially the same height as each other.

23. The air intake system of the engine as defined in claim 21, wherein:

the manifold has an installation opening which opens at a side of the throttle box, ends on the upstream side of the intake element are monolithically connected to the installation opening, and the intake element extends in a downwardly curved configuration from said connected point, and an end on the downstream side of the intake element is mounted on the engine.

24. The air intake system of the engine as defined in claim 21, wherein the installation openings which open at both sides of the manifold have the same form as each other, and the openings of a pair of intake pipes have the same form as each other.

25. The air intake system of the engine as defined in claim 21, wherein:

the manifold has installation openings which open at both sides of the manifold opposite to each other, the intake element is provided with intake pipes, the ends on the upstream side of each of the intake pipes are monolithically connected to each of the installation openings, and each of the intake pipes extends in a downwardly curved configuration from each of said connected points and a pair of ends on the downstream side of the intake pipes are mounted on the engine.

26. The air intake system of the engine as defined in claim 21, wherein:

the intake element is provided with intake pipes and installation flanges on the upstream side and the downstream side for connecting ends on the upstream and downstream sides of the intake tube to each of the installation openings of the throttle box and an intake port of the engine, the installation flange on the upstream side has an installation flange body in contact with the side surface of the manifold along a periphery of the installation opening and an inserting part, which is protruded on the installation flange, for inserting in the installation opening, and the periphery of the installation opening and the installation flange body are bonded to each other by ultra sonic welding.

27. The air intake system of the engine as defined in claim 21, wherein the manifold is monolithically molded from a resin, and the intake manifold is monolithically cast from a metal or resin, or monolithically molded from the resin.

28. The air intake system of the engine as defined in claim 21, wherein an inter cooler is used instead of the cleaner, and the inter cooler is connected to the manifold at substantially the same height as the throttle box.

29. An air intake system of an engine for introducing air passed through a case into a manifold through a throttle, and distributing the air from the manifold to each cylinder of the engine by an intake element, comprising:

both sides of the manifold opposite to each other wherein the manifold is mounted on an upper side of the engine through the intake element, the case being connected to the manifold, plural intake pipes provided side by side and vertically to both of the sides of the manifold opposite to each other in the intake element, each end on an upstream side of the intake pipes being opened and each end on a downstream side of the intake pipes connecting to each of intake ports of the engine, a center axis of the throttle in the manifold being substantially horizontal and centered in the vertical direction between the ends on the upstream side of the intake pipes extended to a center between the ends on the upstream side opposite to each other provided on both sides of the manifold, and wherein said case comprises an inter cooler connected to the manifold at substantially the same height as the manifold.

30. An air intake system of an engine which introduces a fresh air passed through a case and into a manifold through a throttle, and distributes the air from the manifold to each cylinder of the engine by an intake element, wherein the manifold and the intake element, which are separately formed in advance, are bonded to each other by monolithically connecting an installation opening which opens at the manifold to an end on an upstream side of the intake element, and an end on a downstream side of the intake element is mounted on an upper side of the engine, and the case is an inter cooler that is connected to the manifold substantially the same height as each other.

* * * * *